US007277663B2

(12) United States Patent
Kimijima et al.

(10) Patent No.: US 7,277,663 B2
(45) Date of Patent: Oct. 2, 2007

(54) DRIVE FORCE TRANSMITTING MECHANISM, AND IMAGE FORMING APPARATUS INCLUDING THE DRIVE FORCE TRANSMITTING MECHANISM

(75) Inventors: Masashi Kimijima, Yokohama (JP); Satoshi Araaki, Tokyo (JP); Fumihiro Tsunoda, Miyagi-ken (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 11/255,884

(22) Filed: Oct. 24, 2005

(65) Prior Publication Data

US 2006/0088340 A1 Apr. 27, 2006

(30) Foreign Application Priority Data

Oct. 25, 2004 (JP) ..... 2004-309547

(51) Int. Cl.
*G03G 15/00* (2006.01)

(52) U.S. Cl. ..... 399/167

(58) Field of Classification Search ..... 399/36, 399/107, 167; 74/665 GA, 665 GB, 665 GD
See application file for complete search history.

(56) References Cited

U.S. PATENT DOCUMENTS 5,484,140 A 1/1996 Hirose et al.
5,689,764 A * 11/1997 Fukuchi et al. ..... 399/75
5,771,433 A 6/1998 Kimijima et al.
5,848,334 A * 12/1998 Kamola ..... 399/167
6,801,737 B2 * 10/2004 Yanagida ..... 399/167

FOREIGN PATENT DOCUMENTS

JP 11-119583 4/1999

* cited by examiner

*Primary Examiner*—Hoang Ngo
(74) *Attorney, Agent, or Firm*—Oblon, Spivak, McClelland, Maier & Neustadt, P.C.

(57) ABSTRACT

A drive force transmitting mechanism includes a first gear rotatably supported by a first shaft element, a first gear holding unit including the first shaft element and a first support element supporting the first shaft element, a second gear rotatably supported by a second shaft element, a second gear holding unit including the second shaft element and a second support element supporting the second shaft element. The second gear holding unit moves relative to the first gear holding unit, to thereby contact and separate the second gear with and from the first gear. A drive force is transmitted from the first gear to the second gear engaged therewith. A movement of the second gear is regulated by abutting the second shaft element against a curved surface of the first support element that curves at a predetermined curvature relative to an axis line of the first shaft element.

24 Claims, 11 Drawing Sheets

DRIVE FORCE TRANSMITTING MECHANISM, AND IMAGE FORMING APPARATUS INCLUDING THE DRIVE FORCE TRANSMITTING MECHANISM

CROSS-REFERENCE TO RELATED APPLICATIONS

This application claims priority to Japanese Patent Application No. 2004-309547 filed in the Japanese Patent Office on Oct. 25, 2004, the entire contents of each of which is herein incorporated by reference.

BACKGROUND OF THE INVENTION

1. Field of the Invention

The present invention relates to a drive force transmitting mechanism including two gears that rotate while being engaged with each other, in which one of the gears that is movably supported is configured to contact and separate from the other gear. The present invention also relates to an image forming apparatus including the drive force transmitting mechanism.

2. Discussion of the Related Art

A drive force transmitting mechanism that rotates a drive gear and a driven gear while being engaged with each other to transmit a drive force from the drive gear to the driven gear has been widely used. For example, in an image forming apparatus such as a copying machine, a facsimile machine, a laser beam printer, or other similar image forming apparatus, in which a drive motor acting as a drive source is fixed to a case of the image forming apparatus, a driven unit including a photoreceptor and a developing device, for example, is slidably supported in the case such that the driven unit is detachably attached to the case. In this image forming apparatus, a driven gear provided in the driven unit contacts and separates from a drive gear provided to the case of the image forming apparatus by a sliding movement of the driven unit. In another image forming apparatus described in Published Japanese patent application No. 11-119583, a cover mounted with driven elements such as pairs of sheet conveyor rollers is configured to be opened and closed relative to a case of the image forming apparatus to which a motor is fixed. In this image forming apparatus, a driven gear provided to the cover contacts and separates from a drive gear provided to the case of the image forming apparatus by opening and closing the cover.

In these image forming apparatuses, the following forces are exerted on the movable driven gear at a position where the drive gear and the driven gear rotate while being engaged with other, in reaction to the rotations of the drive gear and the driven gear. For example, a force for further intruding the driven gear into the drive gear and a force for moving the driven gear away from the drive gear are exerted on the driven gear. If the driven gear excessively intrudes into the drive gear, the drive gear and the driven gear are locked. If the driven gear moves away from the drive gear, a distance between an axial center of the drive gear and an axial center of the driven gear increases, thereby making the rotational speed of the driven gear unstable.

To prevent an excessive intrusion of a driven gear into a drive gear, a drive force transmitting mechanism including a disk portion has been used. Specifically, the disk portion is provided to at least one of the drive gear and the driven gear such that the disk portion and a gear portion of the at least one of the drive gear and the driven gear are disposed side by side in the rotational axial direction of the at least one of the drive gear and the driven gear. The disk portion has a diameter greater than that of the gear portion. In this drive force transmitting mechanism, an excessive approach of one of the gears (first gear) to the other gear (second gear) is prevented by abutting the disk portion provided to the first gear against a shaft member that supports the second gear. However, in this drive force transmitting mechanism, if the disk portion provided to the first gear is abutted against the shaft member that supports the second gear, the rotation of the first gear may be hampered, thereby increasing a drive torque of a drive motor acting as a drive source.

Further, to prevent a movement of a driven gear away from a drive gear, a drive force transmitting mechanism, in which a movable support element that supports the driven gear and its shaft member is biased toward the drive gear with a spring, has been used. In this drive force transmitting mechanism, the movement of the driven gear away from the drive gear is hampered by the biasing force of the spring. By doing so, the driven gear may stably rotate in the vicinity of the drive gear. However, in this drive force transmitting mechanism, the movement of the driven gear away from the drive gear may not be securely prevented for the following reasons.

Generally, in a configuration in which the driven gear is configured to be movable with the support element that supports the driven gear, a loose movement of the support element is allowed to slide or open/close the support element smoothly. With the loose movement of the support element, the support element can move within a predetermined range in a direction (hereafter referred to as "a loosing direction") different from a sliding direction or an opening/closing direction of the support element. In this loose movement of the support element, the support element that supports the driven gear which rotates while being engaged with the drive gear, typically moves away from the drive gear in the loosing direction as well as in the sliding direction or the opening/closing direction. Thus, even if the movement of the support element in the sliding direction or the opening/closing direction can be prevented with the biasing force of the spring, the movement of the support element in the loosing direction may not be hampered. Even if the movement of the support element in the loosing direction can be prevented with biasing forces of a plurality of springs, the movement of the support element may not be adequately prevented if the biasing forces of the springs get weakened due to the deterioration of the springs.

The above-described problems may similarly occur when a drive roller moves relative to a driven roller, that is, the drive roller contacts and separates from the driven roller.

Therefore, it is desirable to provide a drive force transmitting mechanism that prevents an excessive intrusion of a movable second gear into a first gear while controlling the increase of a drive torque of a drive source, and that prevents the movement of the second gear away from the first gear engaged with the second gear.

SUMMARY OF THE INVENTION

According to an aspect of the present invention, a drive force transmitting mechanism includes a first gear rotatably supported by a first shaft element, and a first holding unit configured to hold the first gear. The first holding unit includes the first shaft element, and a first support element configured to support the first shaft element. The first support element includes a curved surface that curves at a predetermined curvature relative to an axis line of the first shaft element. The drive force transmitting mechanism further includes a second gear rotatably supported by a second shaft element, and a second holding unit configured to hold the second gear. The second holding unit includes the second shaft element, and a second support element configured to support the second shaft element. The second holding unit is configured to move relative to the first holding unit, to thereby contact and separate the second gear with and from the first gear. A drive force is transmitted from the first gear to the second gear that is engaged with the first gear when the second holding unit moves to a predetermined position, and a movement of the second gear held by the second holding unit is regulated by abutting the second shaft element against the curved surface.

According to another aspect of the present invention, an image forming apparatus includes a visual image recording device configured to record a visual image on a recordings material, a conveyor device configured to convey the recording material to the visual image recording device, a drive source configured to produce a drive force, and the above-described drive force transmitting mechanism configured to transmit the drive force from the drive source to the conveyor device.

BRIEF DESCRIPTION OF THE DRAWINGS

A more complete appreciation of the present invention and many of the attendant advantages thereof will be readily obtained as the same becomes better understood by reference to the following detailed description of non-limiting embodiments when considered in connection with the accompanying drawings, wherein.

DESCRIPTION OF THE PREFERRED EMBODIMENTS

Figure 1:
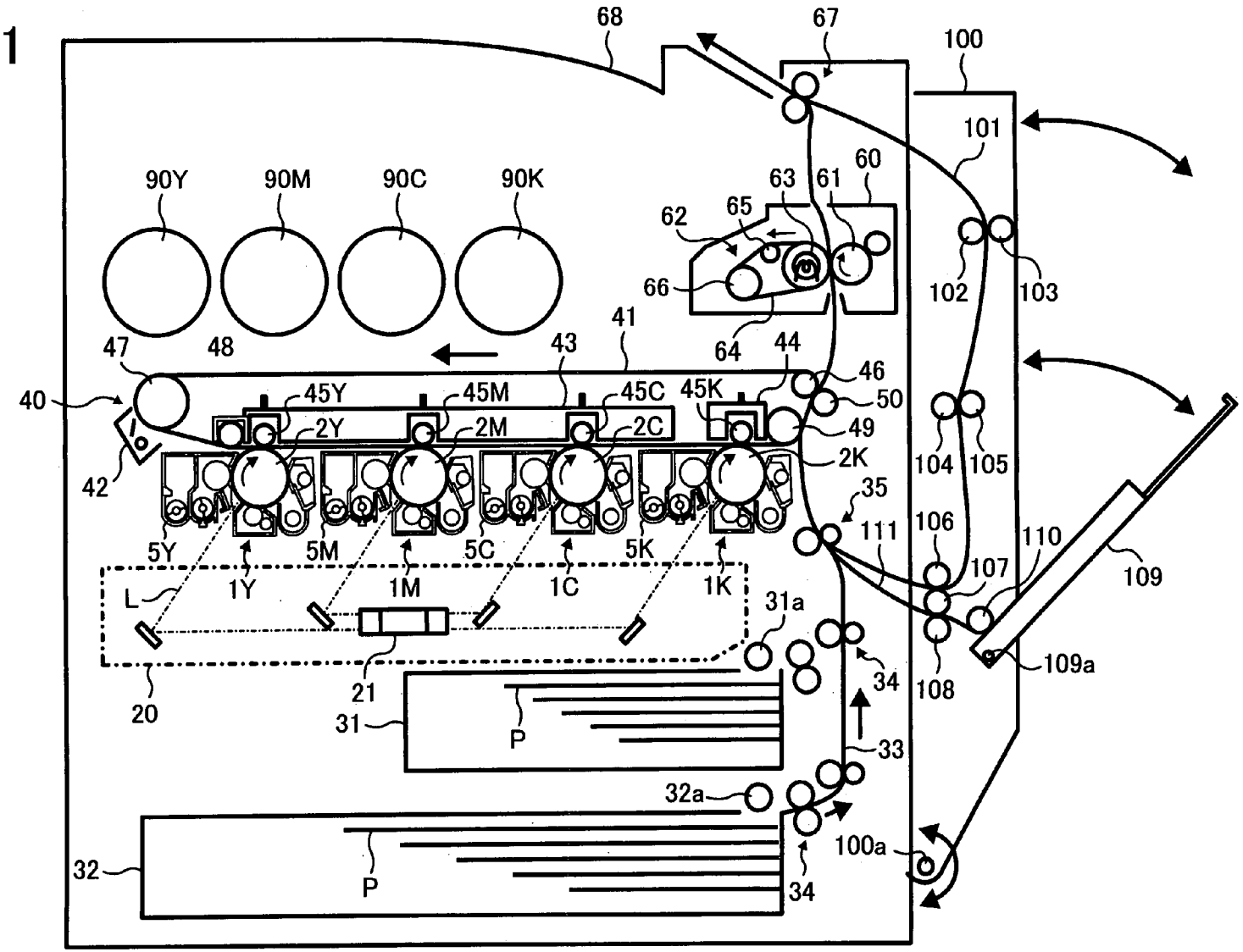
FIG. 1 is a schematic view of a color laser printer according to an embodiment of the present invention.

Non-limiting embodiments of the present invention are now described with reference to the drawings, wherein like reference numerals designate identical or corresponding parts throughout the several views. The present invention is applied to a tandem-type color laser printer (hereafter referred to as a "printer") as a non-limiting example of an image forming apparatus, in which a plurality of image forming units (including drum-shaped photoreceptors) are arranged along an intermediate transfer belt as an intermediate transfer element in the direction of movement of the intermediate transfer belt.

FIG. 1 is a schematic view of a color laser printer according to an embodiment of the present invention. The printer of FIG. 1 includes process units 1Y, 1M, 1C, and 1K that form yellow, magenta, cyan, and black toner images, respectively. The reference letters "Y", "M", "C", and "K" indicate members used for forming a yellow toner image, a magenta toner image, a cyan toner image, and a black toner image, respectively. In the printer of FIG. 1, the process units 1Y, 1M, 1C, and 1K form yellow, magenta, cyan, and black toner images, respectively, and their configurations are substantially the same except for the color of their toner. For this reason, only the configuration of the process unit 1Y will be described hereinafter in detail.

Figure 2:
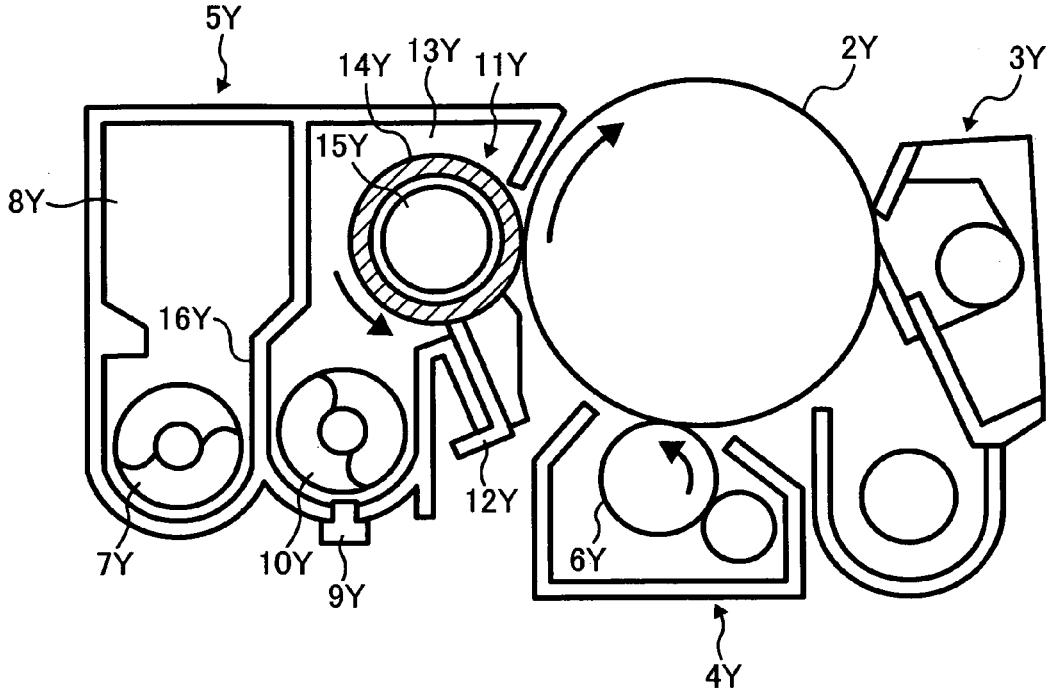
FIG. 2 is an enlarged view of a process unit that forms a yellow toner image in the color laser printer of FIG. 1.

FIG. 2 is an enlarged view of the process unit 1Y that forms a yellow toner image. The process unit 1Y includes a latent image carrier, such as a drum-shaped photoreceptor 2Y, a drum-cleaning device 3Y, a discharging device (not shown), a charging device 4Y, and a developing device 5Y. The process unit 1Y is detachably attached to the main body of the printer of FIG. 1. The process unit 1Y is replaced with a new one at the end of its useful life.

The charging device 4Y uniformly charges the surface of the photoreceptor 2Y driven to rotate in a clockwise direction in FIG. 2 by a drive device (not shown). The charging device 4Y uniformly charges the surface of the photoreceptor 2Y by contacting a charging roller 6Y with the photoreceptor 2Y while applying a charging bias to the charging roller 6Y from a power supply (not shown). The charging roller 6Y is rotated in the counter-clockwise direction. As an alternative to the charging roller 6Y, a charging brush may contact the photoreceptor 2Y. Further, in place of the charging roller 6Y, a charging member may be a non-contact type charging member, such as, a scorotron charger. A laser writing unit 20 (described below) emits a laser beam to the surface of the photoreceptor 2Y which has been uniformly charged by the charging device 4Y, thereby forming an electrostatic latent image thereon. Subsequently, the electrostatic latent image is developed with yellow toner into a yellow toner image by the developing device 5Y.

The developing device 5Y includes a first developer container section 8Y in which a first developer conveying screw 7Y is disposed. The developing device 5Y further includes a second developer container section 13Y in which a toner density sensor 9Y (hereafter referred to as a "T sensor") formed from a magnetic permeability sensor, a second developer conveying screw 10Y, a developing roller 11Y, and a doctor blade 12Y are disposed. The first developer container section 8Y and the second developer container section 13Y include a two-component yellow developer (not shown) containing magnetic carrier and negatively charged yellow toner. The first developer conveying screw 7Y conveys the yellow developer in the first developer container section 8Y from a front side to a rear side in FIG. 2 by being rotated by a drive device (not shown). Then, the yellow developer enters the second developer container section 13Y through a communication opening (not shown) provided in a partition wall 16Y disposed between the first developer container section 8Y and the second developer container section 13Y. The second developer conveying screw 10Y conveys the yellow developer in the second developer container section 13Y from the rear side to the front side in FIG. 2 by being rotated by a drive device (not shown).

The T sensor 9Y attached onto a bottom portion of the second developer container section 13Y is configured to detect a density of yellow toner in the yellow developer. A developing roller 11Y is disposed at an upper portion of the second developer conveying screw 10Y in FIG. 2 in parallel to the second developer conveying screw 10Y. The developing roller 11Y includes a cylindrical-shaped non-magnetic pipe 14Y driven to rotate in the counter-clockwise direction in FIG. 2 by a drive device (not shown), and a magnet roller 15Y fixed at a position inside of the non-magnetic pipe 14Y. The yellow developer conveyed by the second developer conveying screw 10Y is scooped up to the surface of the non-magnetic pipe 14Y by a magnetic force generated at the magnet roller 15Y. Then, a doctor blade 12Y regulates a height of the developer on the developing roller 11Y. The doctor blade 12Y opposes the non-magnetic pipe 14Y at a space formed between the doctor blade 12Y and the non-magnetic pipe 14Y. Subsequently, when the regulated yellow developer is carried to a developing region where the developing roller 11Y faces the photoreceptor 2Y, the yellow toner in the developer is electrostatically attracted to an electrostatic latent image formed on the surface of the photoreceptor 2Y. Thereby, the electrostatic latent image is developed as a yellow toner image. The two-component developer in which yellow toner is consumed for developing the electrostatic latent image on the photoreceptor 2Y, is returned onto the second developer conveying screw 10Y by the rotation of the non-magnetic pipe 14Y of the developing roller 11Y. The yellow developer conveyed by the second developer conveying screw 10Y to a position adjacent to an end portion of the second developer container section 13Y returns to the first developer container section 8Y through a communication opening (not shown) provided in the partition wall 16Y.

The T sensor 9Y outputs a voltage value corresponding to the magnetic permeability of the yellow developer conveyed by the second developer conveying screw 10Y. Because the magnetic permeability of the yellow developer is in correlation with the toner density of the developer, the T sensor 9Y outputs a voltage value corresponding to the density of yellow toner. The data of the voltage value output from the T sensor 9Y is transmitted to a control device (not shown). The control device includes a storage device, such as a random-access memory (RAM). The storage device stores data of respective target output voltage values (Vtref) of the T sensors provided in the process units 1Y, 1M, 1C, and 1K, respectively. In the case of using yellow toner, the control device compares the voltage value output from the T sensor 9Y with the target output voltage value (Vtref). Then, the control device drives a yellow toner cartridge 90Y (described below) for a predetermined period of time based on the comparison result. Thereby, the yellow toner accommodated in the yellow toner cartridge 90Y is supplied into the developing device 5Y. Thus, the density of yellow toner in the developer in the developing device 5Y is maintained within a predetermined range by supplying an adequate amount of yellow toner into the developer in which the yellow toner is consumed in a developing process. Such a toner supply control is similarly performed in each of developing devices 5M, 5C, and 5K other than the developing device 5Y in the process units 1M, 1C, and 1K.

The yellow toner image formed on the photoreceptor 2Y is transferred onto an intermediate transfer belt 41 (described below). After image transfer, the drum cleaning device 3Y removes residual toner remaining on the surface of the photoreceptor 2Y, and then the photoreceptor 2Y is uniformly discharged by the discharging device (not shown) to be prepared for a next image forming operation. Similarly to the process unit 1Y, a magenta toner image, a cyan toner image, and a black toner image are formed on the photoreceptors 2M, 2C, and 2K in the process units 1M, 1C, and 1K, respectively, and are sequentially transferred onto the intermediate transfer belt 41.

The laser writing unit 20 is disposed below the process units 1Y, 1M, 1C, and 1K and includes a laser light source (not shown), a polygon mirror 21, f-theta lenses, reflection mirrors, etc. The laser writing unit 20 irradiates the surface of each of the photoreceptors 2Y, 2M, 2C, and 2K with an optically modulated and deflected laser beam "L", thereby forming an electrostatic latent image on the surface of each of the photoreceptors 2Y, 2M, 2C, and 2K. Instead of using the laser writing unit 20, laser writing may be performed by using light-emitting diode (LED) arrays.

The printer includes a first sheet feeding cassette 31 and a second sheet feeding cassette 32 below the laser writing unit 20. Each of the first and second sheet feeding cassettes 31 and 32 accommodates a stack of transfer sheets P as recording materials. Further, each of a first sheet feeding roller 31*a* and a second sheet feeding roller 32*a* presses against the uppermost transfer sheet P. When the first sheet feeding roller 31*a* or the second sheet feeding roller 32*a* is driven to rotate in the counter-clockwise direction in FIG. 1 by a drive device (not shown), the uppermost transfer sheet P is fed out from the first sheet feeding cassette 31 or the second sheet feeding cassette 32 toward a nip part between registration rollers 35 through a sheet conveying path 33. A plurality of pairs of sheet conveying rollers 34 are provided in the sheet conveying path 33. The registration rollers 35 feed out the transfer sheet P toward a secondary transfer nip part (described below) at an appropriate timing.

A transfer unit 40 is disposed above the process units 1Y, 1M, 1C, and 1K, and includes the endless intermediate transfer belt 41. The intermediate transfer belt 41 contacts the photoreceptors 2Y, 2M, 2C, and 2K and forms four transfer nip parts between the intermediate transfer belt 41 and the photoreceptors 2Y, 2M, 2C, and 2K. The transfer unit 40 further includes a belt cleaning unit 42, a first bracket 43, a second bracket 44, four primary transfer rollers 45Y, 45M, 45C, and 45K, a secondary transfer back-up roller 46, a drive roller 47, an auxiliary roller 48, and a tension roller 49. The intermediate transfer belt 41 is spanned around these eight rollers, and is rotated in a counter-clockwise direction indicated by the arrow in FIG. 1 by the drive roller 47 driven by a drive device (not shown). Four primary transfer nip parts are formed between the intermediate transfer belt 41 and the photoreceptors 2Y, 2M, 2C, and 2K with the rear surface of the intermediate transfer belt 41 pressed by the primary transfer rollers 45Y, 45M, 45C, and 45K toward the photoreceptors 2Y, 2M, 2C, and 2K, respectively. At each of the primary transfer nip parts, a primary transfer electric field is formed between the photoreceptor and the primary transfer roller by applying a primary transfer bias having a polarity (e.g., a positive polarity) opposite to that of toner.

A yellow toner image formed on the photoreceptor 2Y is primarily transferred onto the intermediate transfer belt 41 under the influence of the primary transfer electric field and a nip pressure in a primary transfer region. Then, a magenta toner image formed on the photoreceptor 2M, a cyan toner image formed on the photoreceptor 2C, and a black toner image formed on the photoreceptor 2K are sequentially transferred onto the intermediate transfer belt 41 and are each superimposed on the yellow toner image. As a result, a superimposed four-color toner image is formed on the intermediate transfer belt 41.

The secondary transfer back-up roller 46 of the transfer unit 40 contacts a secondary transfer roller 50 via the intermediate transfer belt 41, thereby forming the secondary transfer nip part. A secondary transfer bias is applied to the secondary transfer roller 50 from a power supply (not shown). The superimposed four-color toner image formed on the intermediate transfer belt 41 enters the secondary transfer nip part by the movement of the intermediate transfer belt 41. The registration rollers 35 feed out the transfer sheet P toward the secondary transfer nip part at a timing such that the transfer sheet P contacts the superimposed four-color toner image on the intermediate transfer belt 41 at the secondary transfer nip part. Subsequently, the superimposed four-color toner image is secondarily transferred onto the transfer sheet P under the influence of the secondary transfer bias and a nip pressure in a secondary transfer region. As a result, a full-color image is formed on the transfer sheet P. The transfer sheet P having the full-color image is conveyed to a fixing device 60.

The belt cleaning unit 42 removes residual toner remaining on the surface of the intermediate transfer belt 41, which has passed through the secondary transfer nip part. The belt cleaning unit 42 contacts the intermediate transfer belt 41 while being backed up by the drive roller 47.

The fixing device 60 is disposed above the secondary transfer region, and includes a pressure roller 61 and a fixing belt unit 62. In the fixing belt unit 62, a fixing belt 64 spanning a heating roller 63, a tension roller 65, and a drive roller 66 rotates in the direction indicated by the arrow in FIG. 1. The heating roller 63 includes a heat source such as a halogen lamp, and heats the fixing belt 64 from its rear surface side. The full-color image is fixed onto the surface of the transfer sheet P while the transfer sheet P passes through a nip part between the fixing belt 64 and the pressure roller 61. The transfer sheet P having passed through the fixing device 60 is discharged by a pair of sheet discharging rollers 67 to a stack portion 68 formed at an upper surface of a case of the main body of the printer. Reference characters 90Y, 90M, 90C, and 90K in FIG. 1 indicate toner cartridges that supply toners of different colors to the developing devices 5Y, 5M, 5C, and 5K in the process units 1Y, 1M, 1C, and 1K, respectively. The toner cartridges 90Y, 90M, 90C, and 90K are configured to be detachably attached to the main body of the printer, independently.

An open/close unit 100 is provided on a right side surface of the case of the main body of the printer in FIG. 1. The open/close unit 100 is configured to be opened and closed relative to the case of the main body of the printer by rotating the open/close unit 100 around a unit rotation shaft 10*a* which is provided at a lower part of the open/close unit 100. The unit rotation shaft 10*a* is hingedly mounted to the case of the main body of the printer. The open/close unit 100 includes a reverse conveyor path 101, a pair of a first reverse conveyor roller 102 and a first reverse driven roller 103, and a pair of a second reverse conveyor roller 104 and a second reverse driven roller 105. The open/close unit 100 further includes a third reverse driven roller 106, a dual-purpose roller 107, a manual conveyor roller 108, a manual sheet feeding tray 109, a manual sheet feeding roller 110, and a manual sheet feeding path 111.

In each of the first sheet feeding cassette 31 and the second sheet feeding cassette 32, the transfer sheet P is stacked such that the first-side surface of the transfer sheet P faces upward in the vertical direction. In the sheet conveying path 33 leading to the secondary transfer nip part, the transfer sheet P is conveyed such that its first-side surface faces leftward in FIG. 1. At the secondary transfer nip part, a superimposed four-color toner image formed on the intermediate transfer belt 41 is transferred onto the first-side surface of the transfer sheet P. The printer of the present embodiment is configured to perform a one-side printing mode and a both-side printing mode. In the one-side printing mode, the transfer sheet P having a color image on its first-side surface is conveyed through the fixing device 60 and discharged to the stack portion 68.

In the both-side printing mode, color images are formed on both sides of the transfer sheet P by a so-called switch-back method. Specifically, the sheet discharging rollers 67 start to rotate in the reverse direction immediately before the trailing edge of the transfer sheet P having passed through the fixing device 60 enters the nip part between the sheet discharging rollers 67. By doing so, the transfer sheet P is conveyed downward such that the trailing edge of the transfer sheet P is switched to the leading edge of the transfer sheet P, and enters the reverse conveyor path 101 of the open/close unit 100. In the reverse conveyor path 101, there are provided the first reverse conveyor roller 102, the first reverse driven roller 103, the second reverse conveyor roller 104, the second reverse driven roller 105, the third reverse driven roller 106, and the dual-purpose roller 107. The transfer sheet P entered in the reverse conveyor path 101 is conveyed from the upper side to the lower side in the vertical direction. When the leading edge of the transfer sheet P reaches the end portion of the reverse conveyor path 101, the transfer sheet P proceeds along a curved portion of the path 101 and is conveyed upward in the vertical direction, that is, a sheet conveying direction is reversed. Then, the transfer sheet P is discharged from the reverse conveyor path 101, and is directed to the registration rollers 35 provided on the sheet conveying path 33 in the main body of the printer. The transfer sheet P conveyed again to the registration rollers 35 passes through the secondary transfer nip part such that the second-side surface of the transfer sheet P faces leftward in FIG. 1. A superimposed four-color toner image formed on the intermediate transfer belt 41 is secondarily transferred onto the second-side surface of the transfer sheet P at the secondary transfer nip part. Thus, full-color images are formed on the both sides of the transfer sheet P by conveying the transfer sheet P having a color image transferred on its first-side surface to the reverse conveyor path 101 through the fixing device 60 and by switching back the transfer sheet P to the secondary transfer nip part.

The manual sheet feeding tray 109 that manually feeds the transfer sheet P is rotatably provided around a tray rotation shaft 109*a* which is provided in the open/close unit 100. By rotating the manual sheet feeding tray 109, the manual sheet feeding tray 109 is opened and closed relative to the open/ close unit 100. The manual sheet feeding roller 110 press-contacts a top sheet of a stack of the transfer sheets P (not shown) set on the manual sheet feeding tray 109 that is in an opened position. By rotating the manual sheet feeding roller 110, the top sheet of the stack of the transfer sheets P on the manual sheet feeding tray 109 is fed out to the manual sheet feeding path 111. Subsequently, the top sheet is discharged from the open/close unit 100 through the manual sheet feeding path 111 and is conveyed to the registration rollers 35 provided on the sheet conveying path 33 in the main body of the printer.

In the open/close unit 100, the double-purpose roller 107 acts as a conveyor roller in the reverse conveyor path 101 in a reverse conveyance mode and acts as a conveyor roller in the manual sheet feeding path 111 in a manual sheet feeding mode. Specifically, when the double-purpose roller 107 acts as a conveyor roller in the reverse conveyor path 101, the double-purpose roller 107 is driven to rotate in the counter-clockwise direction in FIG. 1 and directs the transfer sheet P in the reverse conveyor path 101 toward the registration rollers 35 while passing the transfer sheet P through a nip part between the third reverse driven roller 106 and the double-purpose roller 107. When the double-purpose roller 107 acts as a conveyor roller in the manual sheet feeding path 111, the double-purpose roller 107 is driven to rotate in the clockwise direction in FIG. 1 and directs the transfer sheet P in the manual sheet feeding path 111 toward the registration rollers 35 while passing the transfer sheet P through a nip part between the double-purpose roller 107 and the manual conveyor roller 108. As described above, the rotational direction of the double-purpose roller 107 is switched between the reverse conveyance mode and the manual sheet feeding mode.

In the above-described printer according to the embodiment of the present invention, a visual image recording device that records a visual image such as a toner image on the transfer sheet P as a recording material, is configured by the four process units 1Y, 1M, 1C, and 1K, the laser writing unit 20, the transfer unit 40, etc. Further, a conveyor device that conveys the transfer sheet P to the visual image recording device is configured by the plural pairs of the sheet conveying rollers 34, the registration rollers 35, the open/close unit 100, etc.

In the above-described embodiment of the present invention, the printer uses a two-component developer including toner and magnetic carrier for development. However, even if the printer uses a one-component developer including toner, similar effects may be obtained.

Figure 3:
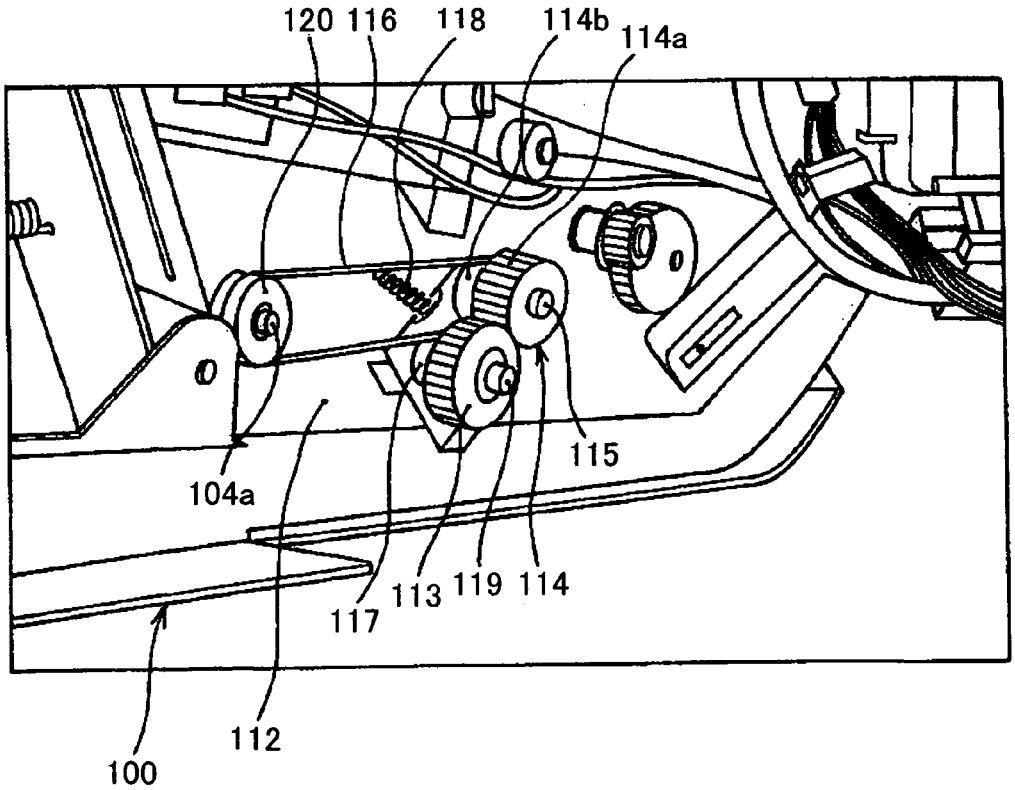
FIG. 3 is an enlarged perspective view of a part of an open/close unit of the color laser printer of FIG. 1.
Figure 4:
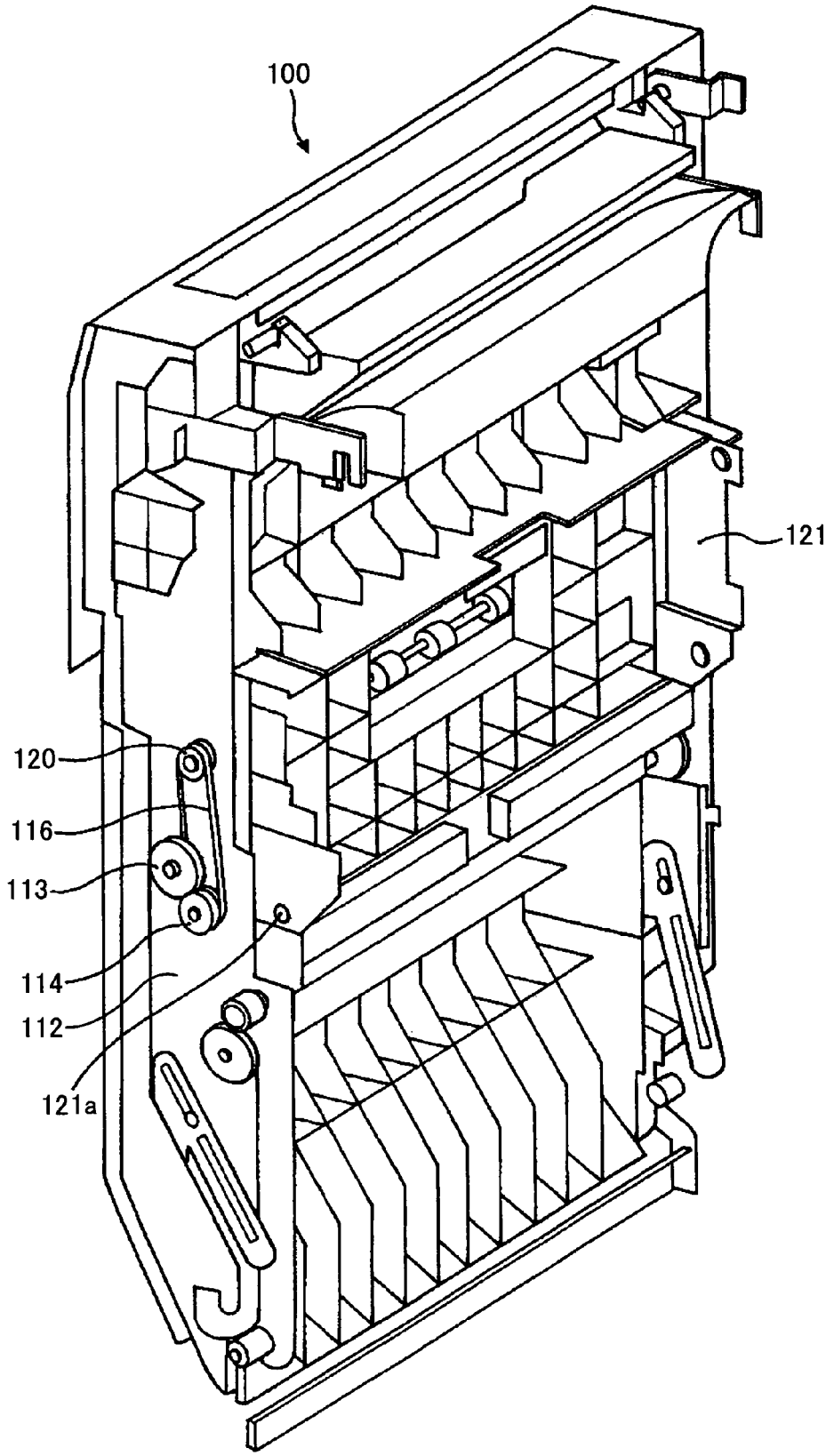
FIG. 4 is a perspective view of the entire open/close unit.

Next, a characteristic configuration of the printer according to the embodiment of the present invention will be described. FIG. 3 is an enlarged perspective view of a part of the open/close unit 100. FIG. 4 is a perspective view of the entire open/close unit 100. With reference to FIGS. 3 and 4, reference numeral 112 indicates a right side plate 112 of the open/close unit 100. A second gear 113 and a relay rotary member 114 are rotatably attached on the right side plate 112. The right side plate 112 rotatably supports a shaft 104*a* of the second reverse conveyor roller 104 illustrated in FIG. 1.

The relay rotary member 114 is formed from a cylindrical main body made of a plastic material including a shaft hole (not shown) at its shaft center portion. A relay stud 115 acting as a swing shaft is made of a metal material. The relay stud 115 is inserted through the shaft hole of the relay rotary member 114 to support the relay rotary member 114, and is fixed on the right side plate 112. The relay rotary member 114 slidably rotates on the circumferential surface of the relay stud 115. The relay rotary member 114 includes a gear portion 114*a* having a plurality of teeth and a pulley portion 114*b* with a V-shaped groove formed on the circumferential surface thereof. The gear portion 114*a* and the pulley portion 114*b* are disposed side by side in the rotational axial direction of the relay rotary member 114. The gear portion 114*a* engages the second gear 113. The V-shaped groove of the pulley portion 114*b* engages a relay belt 116 having a V-shaped cross section stretched around a part of the pulley portion 114*b*.

The relay stud 115 supports a swing bracket 117 as well as the relay rotary member 114. The swing bracket 117 is configured to swing around the relay stud 115 acting as the swing shaft. When any member does not contact the second gear 113, the swing bracket 117 is configured to be located at a predetermined position by being pulled by a coil spring 118 whose one end is attached to the swing bracket 117. As a non-limiting example, the diameter of one end portion of the relay stud 115 is made greater than that of other portions thereof in its longitudinal direction, thereby preventing the drop of the relay rotary member 114 from the relay stud 115.

The second gear 113 is configured to engage a first gear 74 (described below) provided in the main body of the printer, thereby receiving a drive force from a drive source (described below) in the main body of the printer. The second gear 113 transmits the drive force to various types of rotary members in the open/close unit 100. The second gear 113 is formed from a cylindrical main body made of a plastic material including a shaft hole (not shown) at its shaft center portion. A second stud 119 acting as a second shaft element is made of a metal material. The second stud 119 is inserted through the shaft hole of the second gear 113 to support the second gear 113 and is fixed on the swing bracket 117 in a protruding condition. The second stud 119 may be molded integral with the swing bracket 117 or may be attached onto the swing bracket 117 as a separate member. The second gear 113 slidably rotates on the circumferential surface of the second stud 119 while engaging the gear portion 114*a* of the relay rotary member 114. As similarly to the relay stud 115, the diameter of one end portion of the second stud 119 is made greater than that of other portions thereof in its longitudinal direction, thereby preventing the drop of the second gear 113 from the second stud 119.

A second reverse conveyor pulley 120 with a V-shaped groove formed on the circumferential surface thereof is fixed on one end portion of the shaft 104*a* of the second reverse conveyor roller 104 (shown in FIG. 1) which is rotatably supported by the right side plate 112 of the open/close unit 100. The relay belt 116 is stretched around the pulley portion 114*b* of the relay rotary member 114 and the second reverse conveyor pulley 120 to transmit a drive force therebetween.

As illustrated in FIG. 4, a conveyor guide plate 121 for forming the reverse conveyor path 101 (shown in FIG. 1) is rotataly attached to the front surface side of the open/close unit 100. The conveyor guide plate 121 rotates around a rotation shaft 121*a*. If a sheet jam occurs in the reverse conveyor path 101, the conveyor guide plate 121 is exposed by opening the open/close unit 100 by an operator. Then, the reverse conveyor path 101 is exposed by rotating the conveyor guide plate 121 around the rotation shaft 121*a*, so that the operator can remove the jammed sheet from the reverse conveyor path 101.

Figure 5:
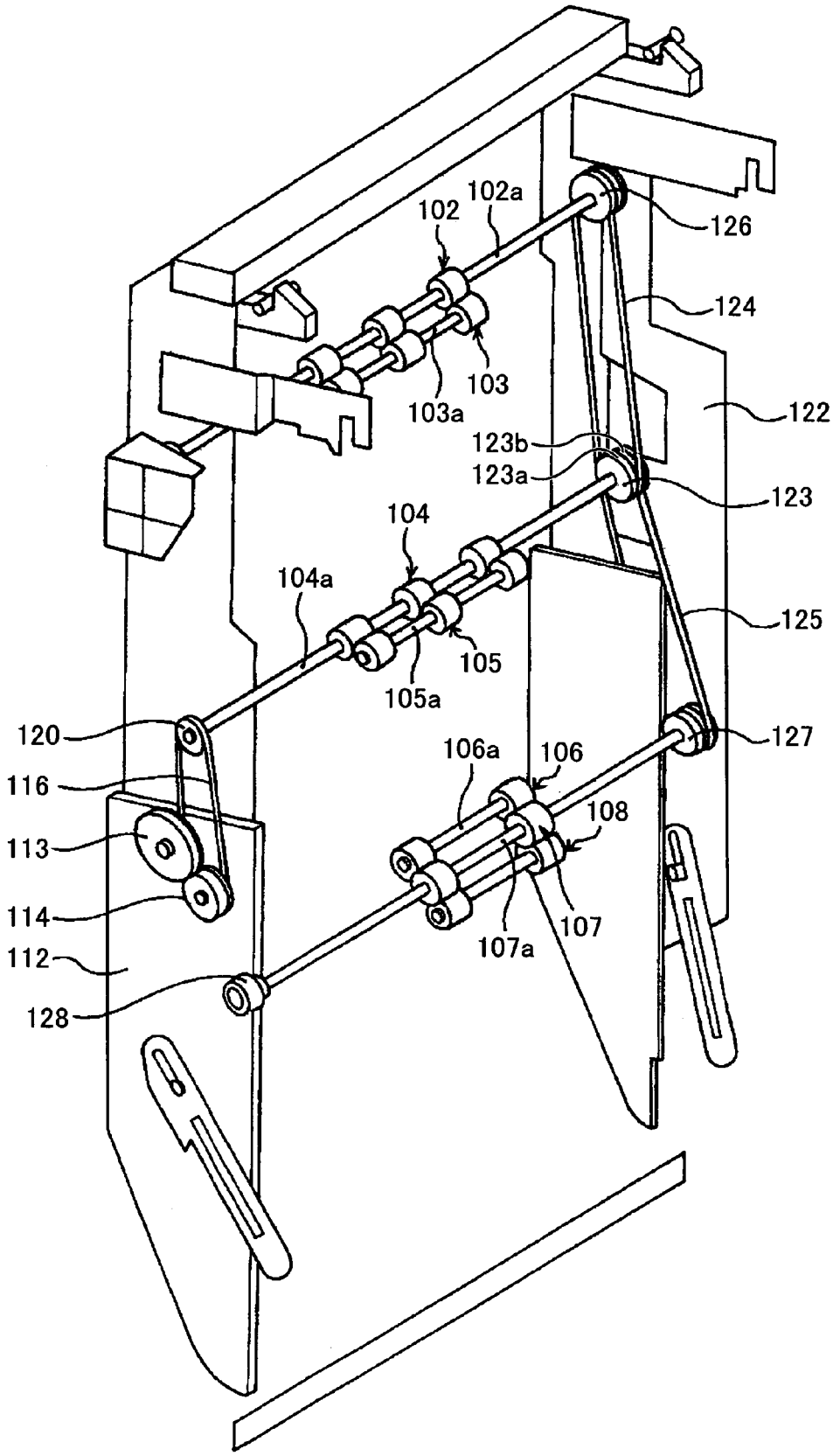
FIG. 5 is an exploded perspective view of a drive force transmitting system in the open/close unit.

FIG. 5 is an exploded perspective view of a drive force transmitting system in the open/close unit 100. The left side of the open/close unit 100 in FIG. 5 corresponds to the rear side of the printer in FIG. 1, and the right side of the open/close unit 100 in FIG. 5 corresponds to the front side of the printer in FIG. 1. The respective both end portions of the shafts 102*a*, 104*a*, and 107*a* of the first reverse conveyor roller 102, the second reverse conveyor roller 104, and the dual-purpose roller 107 are rotatably supported by the right side plate 112 and a left side plate 122 of the open/close unit 100. The right side plate 112 and the left side plate 122 are located on the right side and the left side of the open/close unit 100, respectively, seen from the right hand side in FIG. 1. Each length of the respective shafts 103*a*, 105*a*, 106*a*, and 108*a* of the first reverse driven roller 103, the second reverse driven roller 105, the third reverse driven roller 106, and the manual conveyor roller 108 is less than each length of the respective shafts 102*a*, 104*a*, and 107*a* of the first reverse conveyor roller 102, the second reverse conveyor roller 104, and the dual-purpose roller 107. The respective both end portions of the shafts 103*a*, 105*a*, 106*a*, and 108*a* are rotatably supported by both side support plates (not shown) for the rollers 103, 105, 106, and 108.

A dual-pulley 123 including a first pulley portion 123*a* and a second pulley portion 123*b* is fixed on the end portion of the shaft 104*a* of the second reverse conveyor roller 104 on the front side of the printer. A first relay belt 124 having a V-shaped cross section is stretched around a part of the first pulley portion 123*a*, and a second relay belt 125 having a V-shaped cross section is stretched around a part of the second pulley portion 123*b*.

A first reverse conveyor pulley 126 is fixed on the end portion of the shaft 102*a* of the first conveyor roller 102 on the front side of the printer. The first relay belt 124 is also stretched around a part of the first reverse conveyor pulley 126, thereby transmitting a drive force between the dual-pulley 123 and the first reverse conveyor pulley 126.

A dual-purpose roller pulley 127 is fixed on the end portion of the shaft 107*a* of the dual-purpose roller 107 on the front side of the printer. The second relay belt 125 is also stretched around a part of the dual-purpose roller pulley 127, thereby transmitting a drive force between the dual-pulley 123 and the dual-purpose roller pulley 127.

A dual-purpose roller gear 128 is fixed on the other end portion of the shaft 107*a* of the dual-purpose roller 107 on the rear side of the printer. A drive force is transmitted to the manual sheet feeding roller 110 (shown in FIG. 1) via the dual-purpose roller gear 128.

When the second gear 113 provided in the open/close unit 100 receives a drive force from the drive source in the main body of the printer by engaging the first gear 74 (described below) provided in the main body of the printer, the rotational drive force of the second gear 113 is sequentially transmitted to the relay rotary member 114 and the second reverse conveyor pulley 120, thereby rotating the second reverse conveyor roller 104. Further, the second reverse driven roller 105 is rotated by the second reverse conveyor roller 104.

When the second reverse conveyor roller 104 rotates, the dual-pulley 123, which is located on the front side of the printer, rotates, thereby moving the first relay belt 124 and the second relay belt 125. Then, a drive force is transmitted from the first relay belt 124 to the first reverse conveyor pulley 126, thereby rotating the first reverse conveyor roller 102. As a result, the first reverse driven roller 103 is rotated by the first reverse conveyor roller 102. Further, a drive force is transmitted from the second relay belt 125 to the dual-purpose roller pulley 127, thereby rotating the dual-purpose roller 107. As a result, the third reverse driven roller 106 and the manual conveyor roller 108 are rotated by the dual-purpose roller 107.

As described above, the drive force received by the second gear 113 from the main body side of the printer is sequentially transmitted to the rollers in the open/close unit 100. In the open/close unit 100, a second holding unit configured to hold the second gear 113 is configured by the second stud 119 acting as the second shaft element, and the swing bracket 117/the right side plate 112 acting as a second support element that supports the second stud 119.

Figure 6:
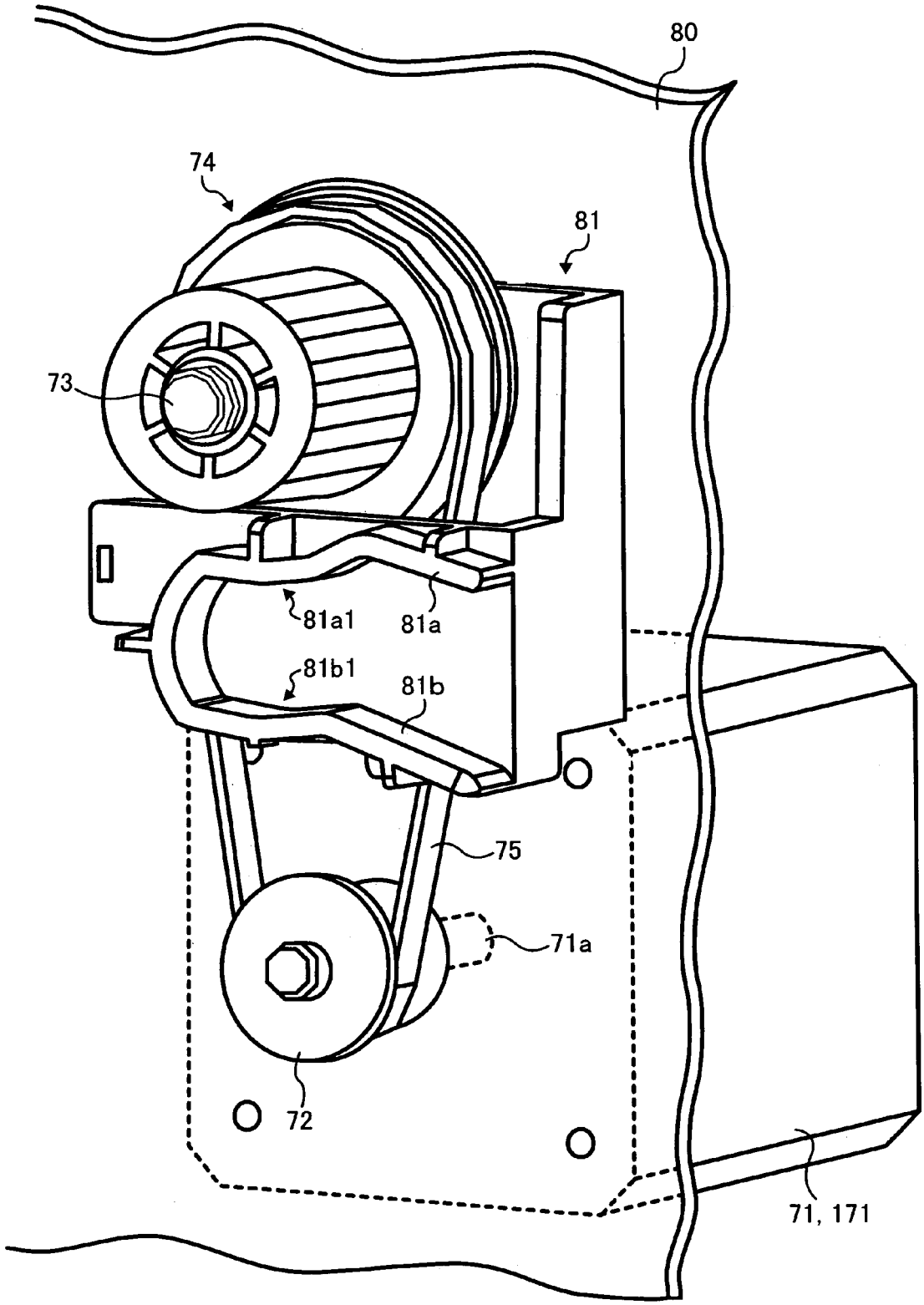
FIG. 6 is an enlarged perspective view of a part of a right side plate of a case of the color laser printer of FIG. 1.

FIG. 6 is an enlarged perspective view of a part of a right side plate 80 of the case of the main body of the printer. With reference to FIG. 6, an open/close unit motor 71 acting as a drive source is fixed on an outer surface of the right side plate 80 such that a motor shaft 71*a* of the open/close unit motor 71 passes through the right side plate 80 from the outer surface side to the inner surface side of the right side plate 80. A drive pulley 72 is fixed on a leading edge portion of the motor shaft 71*a* which is located within the case of the main body of the printer. Further, a drive belt 75 having a V-shaped cross section is fixed on the circumferential surface of the drive pulley 72. A first stud 73 acting as a first shaft element is provided in a protruding condition toward the inside of the case of the main body of the printer at an upper position than a position where the motor shaft 71*a* protrudes from the inner surface of the right side plate 80.

The first gear 74 provided in the main body of the printer is formed from a cylindrical main body made of a plastic material including a shaft hole (not shown) at its shaft center portion. The first stud 73 is inserted through the shaft hole of the first gear 74 to support the first gear 74. The first gear 74 includes a gear portion having a plurality of teeth and a pulley portion with a V-shaped groove formed on the circumferential surface thereof. The gear portion and the pulley portion are disposed side by side in the rotational axial direction of the first gear 74. The drive belt 75 is stretched around a part of the V-shaped groove of the pulley portion of the first gear 74. When the drive pulley 72 rotates at the leading edge portion of the motor shaft 71*a* of the open/close unit motor 71, the drive force of the open/close unit motor 71 is transmitted from the drive pulley 72 to the first gear 74 via the drive belt 75. As a result, the first gear 74 slidably rotates on the first stud 73.

In the printer having the above-described configuration, a first holding unit that holds the first gear 74 is configured by the first stud 73 acting as the first shaft element and the right side plate 80 acting as a first support element that supports the first stud 73. The second gear 113 contacts and separates from the first gear 74 by moving the second gear 113 by opening and closing the open/close unit 100. Thus, in the printer according to the embodiment of the present invention, a drive force transmitting mechanism that causes the second gear 113 to contact and separate from the first gear 74 is configured by the first gear 74, the first stud 73, the right side plate 80 of the case of the main body of the printer, the second gear 113, the second stud 119, and the swing bracket 117/the right side plate 112 of the open/close unit 100.

As described above, the open/close unit 100 is opened and closed relative to the case of the main body of the printer by rotating the open/close unit 100 around the unit rotation shaft 100*a* (shown in FIG. 1). When the open/close-unit 100 is rotated around the unit rotation shaft 100*a* from an opened position to a closed position relative to the case of the main body of the printer, the second gear 113 provided in the open/close unit 100 is rotated around the unit rotation shaft 100*a* in the direction indicated by an arrow X in FIG. 7 toward the first gear 74. When the open/close unit 100 is moved to the closed position, as illustrated in FIG. 8, the second gear 113 is located at a position immediately below the first gear 74 held by the right side plate 80 of the case of the printer, and engages the gear portion of the first gear 74. When the first gear 74 rotates in this engagement condition, the drive force of the open/close unit motor 71 is transmitted from the first gear 74 to the rollers in the open/close unit 100 via the second gear 113 and the relay rotary member 114.

Figure 9:
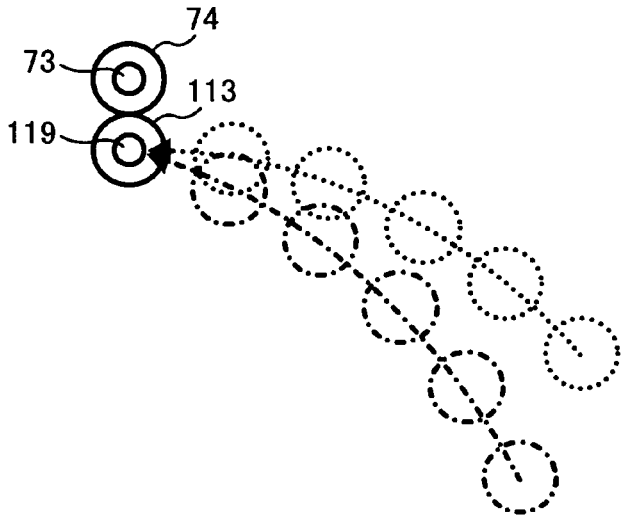
FIG. 9 is a diagram illustrating a rotation locus of the second gear.

FIG. 9 is a diagram illustrating a rotation locus of the second gear 113. The arrow indicated by dotted lines illustrates the rotation locus of the second gear 113 assuming that the unit rotation shaft 100*a* (shown in FIG. 1) of the open/close unit 100 is located below on the vertical of the first stud 73 that supports the first gear 74. The arrow indicated by alternate long and short dashed lines illustrates the rotation locus of the second gear 113 in the printer of the present embodiment. Specifically, in the printer of the present embodiment, the unit rotation shaft 100*a* is located below the first stud 73 at a position closer to the closed position of the open/close unit 100 relative to the position on the vertical of the first stud 73. A plurality of circles illustrated by dotted lines in FIG. 9 show positions of the second gear 113 on the rotation locus indicated by the arrow of the dotted lines when the open/close unit 100 rotates around the unit rotation shaft 100*a* by the rotation angle of 10 degrees toward the main body of the printer. Further, a plurality of circles illustrated by alternate long and short dashed lines in FIG. 9 show positions of the second gear 113 on the rotation locus indicated by the arrow of the alternate long and short dashed lines when the open/close unit 100 rotates around the unit rotation shaft 100*a* by the rotation angle of 10 degrees toward the main body of the printer.

When the unit rotation shaft 100*a* of the open/close unit 100 is located below on the vertical of the first stud 73, the second gear 113 gradually approaches the first gear 74 by closing the open/close unit 100 as shown by the dotted lines in FIG. 9. When the open/close unit 100 is securely closed, the second gear 113 reaches the highest position on the rotation locus in the vertical direction and engages the first gear 74. In contrast, when the unit rotation shaft 100*a* is located below the first stud 73 at a position closer to the closed position of the open/close unit 100 relative to the position on the vertical of the first stud 73, as shown by the alternate long and short dashed lines in FIG. 9, a moving amount of the second gear 113 in the vertical direction per a unit rotation amount of the open/close unit 100 becomes greater. So, the second gear 113 sharply approaches the first gear 74 by closing the open/close unit 100. In this condition, a problem caused by a positional error of attachment of the second gear 113 tends to occur. Specifically, the open/close unit 100 may not be securely closed due to the catch of the second gear 113 by the first gear 74 occurred before closing the open/close unit 100. Even if the open/close unit 100 is securely closed, the second gear 113 may not properly engage the first gear 74, for example, the second gear 113 may be located at a position away from the first gear 74.

Figure 7:
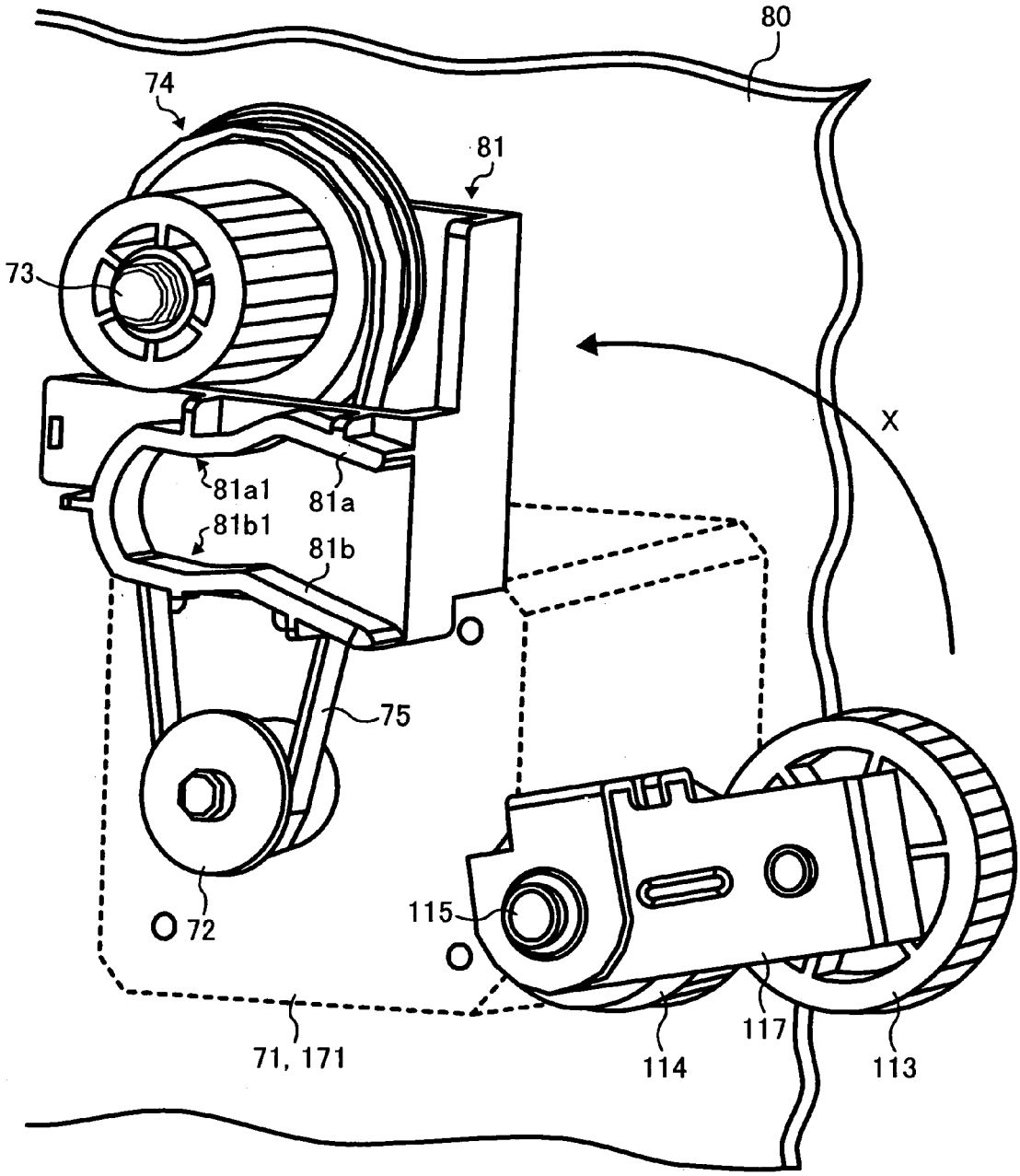
FIG. 7 is an enlarged perspective view of a part of the right side plate of the case of the color laser printer and a second gear moving toward the right side plate.
Figure 8:
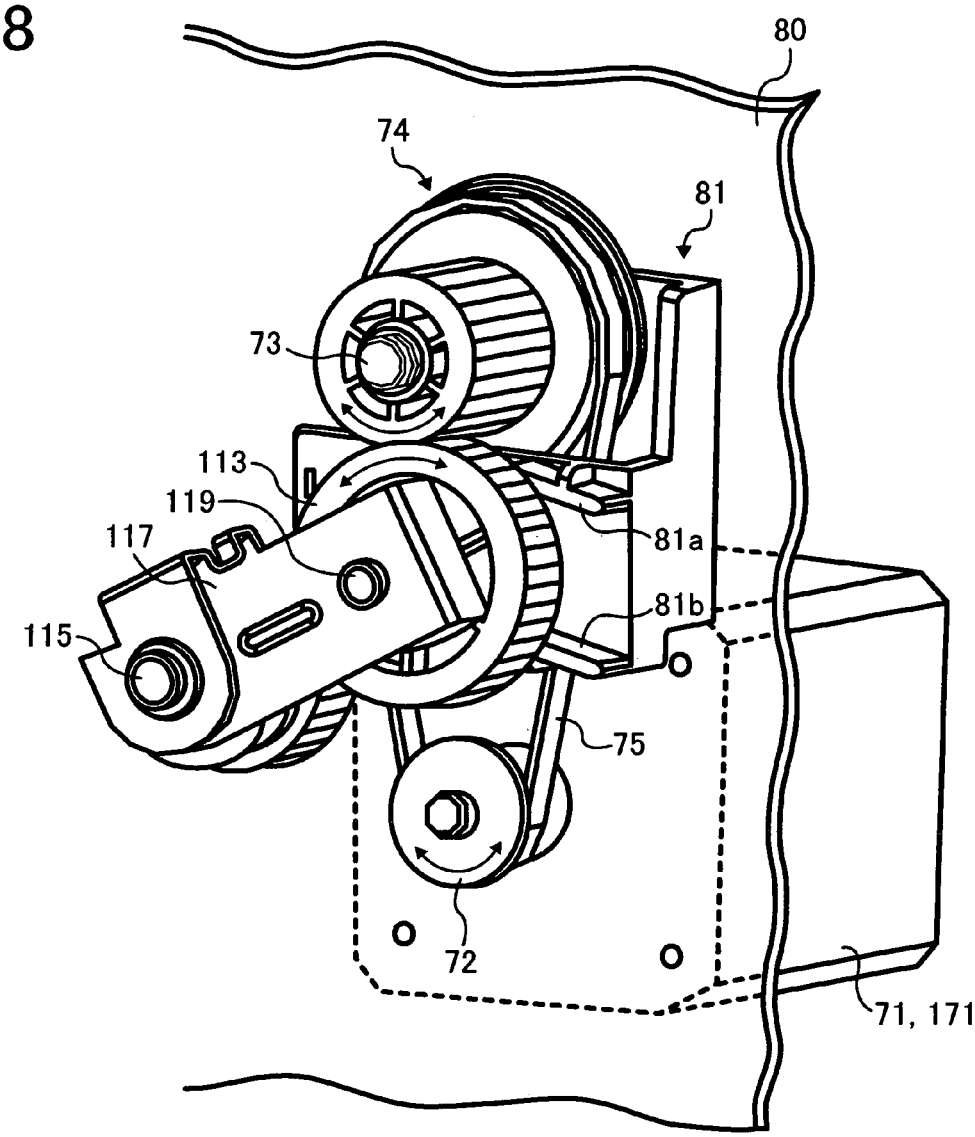
FIG. 8 is an enlarged perspective view of a part of the right side plate of the case of the color laser printer, a first gear, and the second gear engaged with the first gear.

To address this problem, in the printer of the present embodiment, as illustrated in FIGS. 3 and 7, the second gear 113 is supported by the swing bracket 117 that swings around the relay stud 115 supporting the relay rotary member 114. With reference to FIG. 3, the swing bracket 117 rotates in a clockwise direction by being pulled by the coil spring 118 and stops by abutting a stopper (not shown) provided on the right side plate 112 of the open/close unit 100 in a protruding condition. In the printer of the present embodiment, the attachment position of the second gear 113 in the open/close unit 100 is set such that when the open/close unit 100 is closed under the condition that the swing bracket 117 is stopped by the stopper, the second gear 113 abuts the first gear 74 before the closing operation of the open/close unit 100 is completed regardless of whether there is a positional error of attachment of the second gear 113. By setting so, the open/close unit 100 can be closed while preventing the catch of the second gear 113 by the first gear 74 by rotating the swing bracket 117 immediately before closing the open/close unit 100 securely.

For a method of rotating the swing bracket 117 by the closing operation of the open/close unit 100, the abutment of the second gear 113 against the first gear 74 may be used. As described above, it is set that the second gear 113 abuts the first gear 74 by the closing operation of the open/close unit 100 before the open/close unit 100 is securely closed. When the second gear 113 abuts the first gear 74, the coil spring 118, which holds and halts the swing bracket 117 at a predetermined position by the stopper, is pulled downward in FIG. 3 by the subsequent closing operation of the open/close unit 100, thereby rotating the swing bracket 117 around the relay stud 115 in the counter-clockwise direction in FIG. 3. By this rotation of the swing bracket 117, the second gear 113 moves to a position immediately below the first gear 74 while engaging the first gear 74 without an excessive intrusion of the second gear 113 into the first gear 74.

The second gear 113 properly engages the first gear 74 as described above. However, the following problems, such as away-movement and intruding movement of the second gear 113 may arise. Specifically, the rotational direction of the open/close unit motor 71 (shown in FIGS. 6 and 8) is switched between forward and reverse directions. This is for switching the rotational direction of the dual-purpose roller 107 (shown in FIG. 1) to switch a sheet conveyance mode in the open/close unit 100 between the reverse conveyance mode and the manual sheet feeding mode. By switching the rotational direction of the open/close unit motor 71, the rotational direction of each of rotary members provided downstream of the open/close unit motor 71 in the drive force transmitting direction is switched.

When the first gear 74 is rotated in the counter-clockwise direction in FIG. 8, a force for, moving the second gear 113 away from the first gear 74 is exerted on the second gear 113 that rotates in the clockwise direction in FIG. 8 while engaging the first gear 74. By this force, the swing bracket 117 is rotated in the clockwise direction in FIG. 8 around the relay stud 115, and the second gear 113 slightly moves in the direction away from the first gear 74 (i.e., a away-movement). Even if such a away-movement of the second gear 113 occurs, the second gear 113 returns to its original position soon (i.e., a returning movement) because the coil spring 118 attached to the swing bracket 117 pulls the swing bracket 117, thereby rotating the swing bracket 117 in the counter-clockwise direction in FIG. 8. However, the second gear 113 receives the reactive force from the rotating first gear 74 at its original position, thereby moving away from the first gear 74 again. Thus, by repeating the away-movement and returning movement of the second gear 113, the distance between the axial center of the first gear 74 and the axial center of the second gear 113 varies, resulting in a variation of a drive force transmitting speed.

When the first gear 74 is rotated in the clockwise direction in FIG. 8, a force for approaching the first gear 74 is exerted on the second gear 113 that rotates in the counter-clockwise direction in FIG. 8 while engaging the first gear 74. By this force, the swing bracket 117 is rotated in the counter-clockwise direction in FIG. 8 around the relay stud 115, and the second gear 113 gradually introduces into the first gear 74 (i.e., an intruding movement). Consequently, the first gear 74 and the second gear 113 are locked due to excessive intrusion of the second gear 113.

For these reasons, in the printer of the present embodiment, the away-movement and intruding movement of the second gear 113 are regulated by a regulating guide member. Specifically, with reference to FIG. 6, a regulating guide member 81 made of polyacetal resin is fixed on the metallic right side plate 80 of the case of the printer that supports the first stud 73. The regulating guide member 81 includes a wall-shaped intruding movement regulating guide portion 81*a* and a wall-shaped away-movement regulating guide portion 81*b*, both of which stand on the right side plate 80 in a direction perpendicular to the surface of the right side plate 80.

The away-movement regulating guide portion 81*b* stands at a position where the intruding movement regulating guide portion 81*a* is interposed between the first gear 74 and the away-movement regulating guide portion 81*b*. The intruding movement regulating guide portion 81*a* includes a convex curved surface 81*a*1 that curves at a predetermined curvature relative to the axis line of the first stud 73. The convex curved surface 81*a*1 is located at around one end portion of the intruding movement regulating guide portion 81*a* facing the away-movement regulating guide portion 81*b*, that is, at a position immediately below the first gear 74. The convex curved surface 81*a*1 is in the shape of an arc concentric with the first stud 73. The convex curved surface 81*a*1 is curved outward in a direction away from the first stud 73. The away-movement regulating guide portion 81*b* includes a concave curved surface 81*b*1 that curves at a predetermined curvature relative to the axis line of the first stud 73. The concave curved surface 81*b*1 is located at around one end portion of the away-movement regulating guide portion 81*b* facing the intruding movement regulating guide portion 81*a*, that is, at a position immediately below the first gear 74. The concave curved surface 81*b*1 is also in the shape of an arc concentric with the first stud 73. The concave curved surface 81*b*1 is curved outward in a direction away from the first stud 73.

Figure 10:
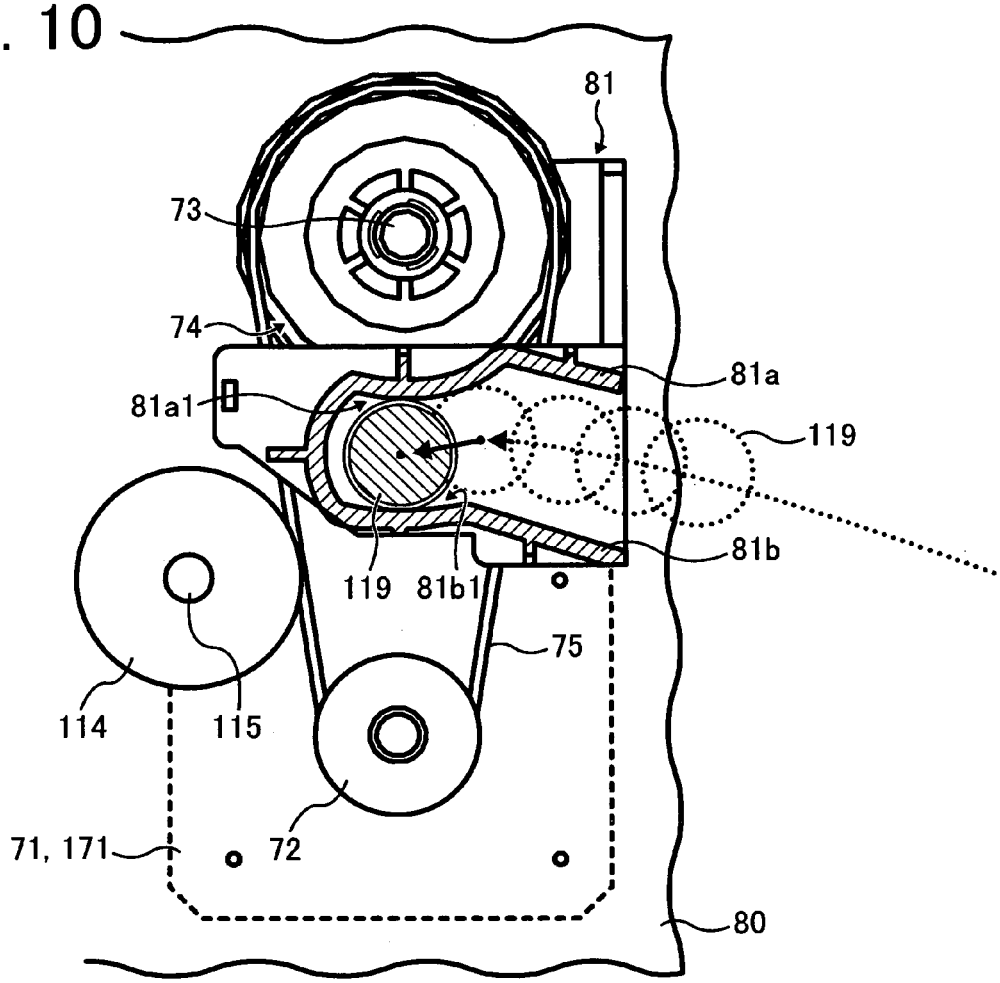
FIG. 10 is an enlarged side view of a part of the right side plate of the case of the color laser printer seen from the inside of the case of the printer.

FIG. 10 is an enlarged side view of a part of the right side plate 80 of the case of the printer seen from the inside of the case of the printer. The dotted lines in FIG. 10 indicate a rotational movement orbit of the second stud 119 supported in the open/close unit 100 during the open/close unit 100 rotates from the opened position to the closed position. When the open/close unit 100 rotates to a position near the closed position, the second stud 119 further proceeds in the rotational movement orbit with its end portion located between the intruding movement regulating guide portion 81*a* and the away-movement regulating guide portion 81*b* of the regulating guide member 81.

When the closing operation of the open/close unit 100 is almost completed and when the second gear 113 moves to a position where the second gear 113 may appropriately engage the first gear 74 by the closing operation of the open/close unit 100, the circumferential surface of the end portion of the second stud 119 abuts the convex curved surface 81*a*1 of the intruding movement regulating guide portion 81*a*. By this abutment, the additional intrusion of the second gear 113 into the first gear 74 is prevented. Subsequently, the swing bracket 117 gradually rotates in the clockwise direction in FIG. 8 around the relay stud 115 by closing the open/close unit 100. The second stud 119 advances in the rotational movement orbit formed around the axis line of the first stud 73 instead of a rotational movement orbit formed around the unit rotation shaft 100*a* (shown in FIG. 1) of the open/close unit 100 while slidably contacting the circumferential surface of the end portion of the second stud 119 with the convex curved surface 81*a*1 of the intruding movement regulating guide portion 81*a*.

When the open/close unit 100 is securely closed, the second stud 119 and the second gear 113 are located at the position immediately below the first stud 73. The upper side circumferential surface of the end portion of the second stud 119 located immediately below the first stud 73 abuts the convex curved surface 81*a*1 of the intruding movement regulating guide portion 81*a* with its end portion biased by the coil spring 118 (shown in FIG. 3). Further, the lower side circumferential surface of the end portion of the second stud 119 opposes the concave curved surface 81*b*1 of the away-movement regulating guide portion 81*b* with a small gap formed therebetween.

When the open/close unit 100 is securely closed, an engagement claw (not shown) of the open/close unit 100 engages a pin (not shown) of the case of the main body of the printer, and thereby the open/close unit 100 is locked. The movement of the second stud 119 in the opening/closing direction of the open/close unit 100 is regulated by this lock. However, the movement of the second stud 119 in a direction different from the opening/closing direction of the open/close unit 100, such as a loosing direction of the open/close unit 100, and the swing direction of the swing bracket 117, may not be regulated by this lock. In the printer of the present embodiment, the regulating guide member 81 regulates the movement of the second stud 119 and the second gear 113 in such a direction different from the opening/closing direction of the open/close unit 100.

When the open/close unit motor 71 is rotated in a forward direction under the condition that the open/close unit 100 is closed, the first gear 74 is driven to rotate in the clockwise direction in FIG. 10. Consequently, a force for further approaching the first gear 74 is exerted on the second gear 113 which rotates while engaging the first gear 74. However, because the circumferential surface of the end portion of the second stud 119 is made in abutment against the convex curved surface 81*a*1 of the intruding movement regulating guide portion 81*a*, the movement of the second gear 113 (and the second holding unit) in a direction for decreasing the distance between the axial center of the first gear 74 and the axial center of the second gear 113, that is, the intruding movement of the second gear 113, is regulated. In the printer of the present embodiment, the intruding movement of the second gear 113 into the first gear 74 is regulated by regulating the movement of the second stud 119 relative to the axial center of the first stud 73 by the abutment of the circumferential surface of the end portion of the second stud 119 against the convex curved surface 81*a*1 of the intruding movement regulating guide portion 81*a*. In this configuration, even if the second stud 119 strongly abuts the convex curved surface 81*a*1, the rotation of the first gear 74 supported by the first stud 73 may not be hampered. Thus, the excessive intrusion of the second gear 113 into the first gear 74 can be prevented while controlling the increase of the drive torque of the open/close unit motor 71.

When the open/close unit motor 71 is rotated in a reverse direction under the condition that the open/close unit 100 is closed, the first gear 74 is driven to rotate in the counterclockwise direction in FIG. 10. Consequently, a force for moving the second gear 113 away from the first gear 74 is exerted on the second gear 113 which rotates while engaging the first gear 74. When the second gear 113 slightly moves away from the first gear 74 due to this force, the lower side circumferential surface of the end portion of the second stud 119 abuts the concave curved surface 81*b*1 of the away-movement regulating guide portion 81*b*. By this abutment, the movement of the second gear 113 (and the second holding unit) in a direction for increasing the distance between the axial center of the first gear 74 and the axial center of the second gear 113, that is, the away-movement of the second gear 113, is regulated. In the printer of the present embodiment, the away-movement of the second gear 113 from the first gear 74 is regulated by regulating the movement of the second stud 119 relative to the axial center of the first stud 73 by the abutment of the circumferential surface of the end portion of the second stud 119 against the concave curved surface 81*b*1 of the away-movement regulating guide portion 81*b*. In this configuration, even if the bias force of the coil spring 118 gets weakened due to its deterioration, the away-movement of the second gear 113 is securely regulated by the abutment of the second stud 119 against the concave curved surface 81*b*1. Further, the away-movement of the second gear 113 may be regulated not only in a predetermined angular orientation but also within an angular range in a direction normal to the axis line of the first stud 73 by the abutment of the circumferential surface of the end portion of the second stud 119 against the concave curved surface 81*b*1.

As described above, the circumferential surface of the end portion of the second stud 119 abuts the convex curved surface 81*a*1 and the concave curved surface 81*b*1. The second stud 119 is unrotatably fixed on the swing bracket 117 in a protruding condition. Further, the second gear 113 rotates on the circumferential surface of the second stud 119 which cannot rotate. In this configuration, even if the second stud 119 strongly abuts the convex curved surface 81*a*1 and the concave curved surface 81*b*1, the rotation of the second gear 113 which rotates on the circumferential surface of the second stud 119 may not be hampered. Thus, it can prevent the increase of the drive torque of the open/close unit motor 71 caused by interference of the rotation of the second gear 113 due to the strong abutment of the second stud 119 which may rotate together with the second gear 113, against the convex curved surface 81*a*1 and the concave curved surface 81*b*1.

Figure 11:
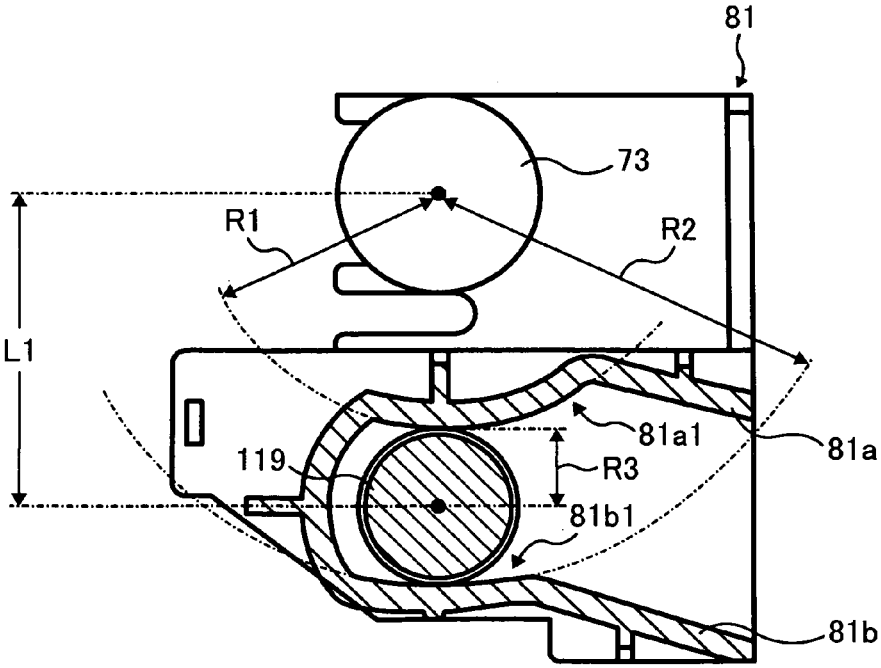
FIG. 11 is an enlarged side view of a regulating guide member, a first stud, and a second stud of the color laser printer.

FIG. 11 is an enlarged side view of the regulating guide member 81, the first stud 73, and the second stud 119. Reference character L1 in FIG. 11 indicates a distance between the axial center of the first gear 74 and the axial center of the second gear 113 when the second gear 113 engages the first gear 74 with an appropriate intrusion amount under the condition that the second stud 119 abuts the convex curved surface 81*a*1. The distance L1 is slightly greater than a minimum distance between the axial center of the first gear 74 and the axial center of the second gear 113 when the second gear 113 engages and intrudes into the first gear 74 to the limit. Further, reference character R1 in FIG. 11 indicates the radius of curvature of the convex curved surface 81*a*1 having its center at the axis line of the first stud 73. Reference character R2 in FIG. 11 indicates the radius of curvature of the concave curved surface 81*b*1 having its center at the axis line of the first stud 73. Moreover, reference character R3 in FIG. 11 indicates the radius of the second stud 119.

With reference to FIG. 11, assuming that the radius R1 of curvature of the convex curved surface 81*a*1 is set to a value less than a value obtained by subtracting the radius R3 of the second stud 119 from the above-described minimum distance between the axial center of the first gear 74 and the axial center of the second gear 113, the second gear 113 intrudes into the first gear 74 to the limit by the closing operation of the open/close unit 100 before abutting the second stud 119 against the convex curved surface 81*a*1. As a result, the first gear 74 and the second gear 113 are locked. Therefore, in the printer of the present embodiment, the radius R1 of curvature of the convex curved surface 81*a*1 is set to a value obtained by subtracting the radius R3 of the second stud 119 from the distance L1 between the axial center of the first gear 74 and the axial center of the second gear 113. Because the distance L1 is greater than the minimum distance, the radius R1 of curvature of the convex curved surface 81*a*1 is set to a value greater than a value obtained by subtracting the radius R3 of the second stud 119 from the minimum distance. By this setting, the occurrence of the above-described locking of the first gear 74 and the second gear 113 before abutting the second stud 119 against the convex curved surface 81*a*1 can be prevented.

With reference further to FIG. 11, assuming that the radius R2 of curvature of the concave curved surface 81*b*1 is set to a value less than a value obtained by adding the radius R3 of the second stud 119 to the above-described minimum distance between the axial center of the first gear 74 and the axial center of the second gear 113, the second gear 113 intrudes into the first gear 74 to the limit by the closing operation of the open/close unit 100. As a result, the first gear 74 and the second gear 113 are locked. Therefore, in the printer of the present embodiment, the radius R2 of curvature of the concave curved surface 81*b*1 is set to a value obtained by subtracting the radius R3 of the second stud 119 from the distance L1 between the axial center of the first gear 74 and the axial center of the second gear 113. Because the distance L1 is greater than the minimum distance, the radius R2 of curvature of the concave curved surface 81*b*1 is set to a value greater than a value obtained by adding the radius R3 of the second stud 119 to the minimum distance. By this setting, the occurrence of the above-described locking of the first gear 74 and second gear 113 can be prevented.

As described above, the right side plate 80 of the case of the main body of the printer is made of a metallic material, such as iron, aluminum, etc. By using the metallic material, the right side plate 80 may have a high rigidity. In contrast, the regulating guide member 81 fixed on the right side plate 80 is made of polyacetal resin instead of a metallic material. In view of cost reduction, the regulating guide member 81 may be preferably formed from the same material as that of the right side plate 80 and may be molded integral with the right side plate 80. However, in the printer of the present embodiment, the regulating guide member 81 is made of a material such as polyacetal resin, different from that of the right side plate 80 for the following reasons. As described above, the end portion of the second stud 119 slidably contacts the convex curved surface 81*a*1 of the regulating guide member 81 by the opening and closing operations of the open/close unit 100. To smoothly opening and closing the open/close unit 100 even if the end portion of the second stud 119 slidably contacts the convex curved surface 81*a*1, a frictional force between the second stud 119 and the convex curved surface 81*a*1 may be preferably decreased. If the regulating guide member 81 is made of a metallic material having a relatively high coefficient of friction, a large frictional force is produced between the convex curved surface 81*a*1 and the second stud 119. Accordingly, a lubricant may be preferably applied to the convex curved surface 81*a*1 at regular intervals to reduce the frictional force. Such an application of lubricant typically degrades the maintenance of the printer. For these reasons, the regulating guide member 81 is made of polyacetal resin in the printer of the present embodiment. By forming the regulating guide member 81 from the material having a low coefficient of friction, the second stud 119 can slidably contact the convex curved surface 81*a*1 smoothly without applying a lubricant to the convex curved surface 81*a*1.

When forming the regulating guide member 81 from a material different from that of the right side plate 80, the regulating guide member 81, which has been manufactured by a process different from that of the right side plate 80, needs to be fixed on the right side plate 80. For fixing the regulating guide member 81 on the right side plate 80, attachment reference positions of the regulating guide member 81 relative to the right side plate 80 are set for the right side plate 80 and the regulating guide member 81, respectively. For example, if the regulating guide member 81 is fixed on the right side plate 80 with a plurality of screws, through-holes corresponding to the screws are provided in the regulating guide member 81, and screw holes corresponding to the screws are provided in the right side plate 80. However, position displacements inevitably occur among the through-holes of the regulating guide member 81 and the screw holes of the right side plate 80 due to the limit of the accuracy of manufacturing. For these reasons, if the inside diameter of each of the through-holes of the regulating guide member 81 is set to almost the outside diameter of the screw, some of the screws passing through the through-holes cannot fit to the positions of the screw holes in the right side plate 80. Therefore, generally, each inside diameter of one or a small number of the through-holes is set to be equal to the outside diameter of the screw, and each of the other through-holes is set to have an inside diameter greater than the outside diameter of the screw. In this configuration, the position of the screw can be adjusted in the hole. Further, in this configuration, each position of one or a small number of the through-holes becomes an attachment reference position in the regulating guide member 81 (hereafter referred to as a "reference through-hole"). Further, each position of the screw holes corresponding to the reference through-hole becomes an attachment reference position in the right side plate 80 (hereafter referred to as a "reference screw hole").

However, the above-described setting of the attachment reference positions is not preferable for the following reasons. In the configuration shown in FIG. 11, the highest position accuracy may be required for the relative position between the first stud 73 and the convex curved surface 81*a*1, and for the relative position between the first stud 73 and the concave curved surface 81*b*1. If these relative positions are deviated from design positions, the distance between the axial center of the first gear 74 and the axial center of the second gear 113 varies. Examples of the causes for the deviations of these relative positions in the above-described setting of the attachment reference positions may include an error of the relative position between the first stud 73 and the reference screw hole in the right side plate 80 and an error of the relative position between the curved surface of the regulating guide member 81 and the through-hole in the regulating guide member 81. If these errors accumulate, it may be difficult to set the distance between the axial center of the first gear 74 and the axial center of the second gear 113 with accuracy.

Figure 12:
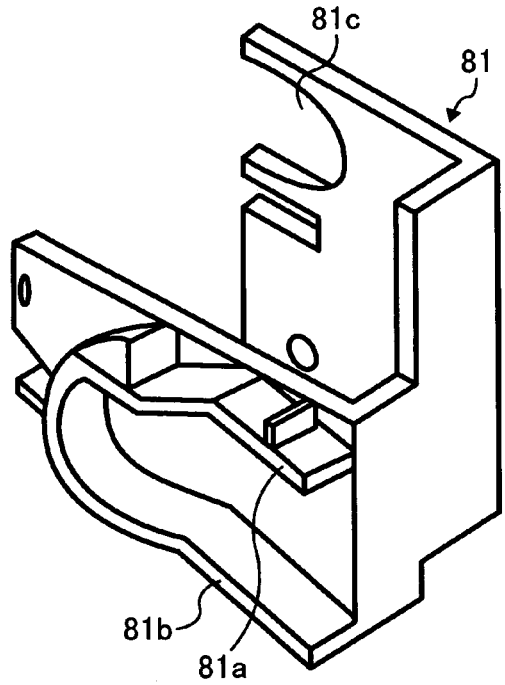
FIG. 12 is a perspective view of the regulating guide member including an arc-shaped cut-away portion.
Figure 13:
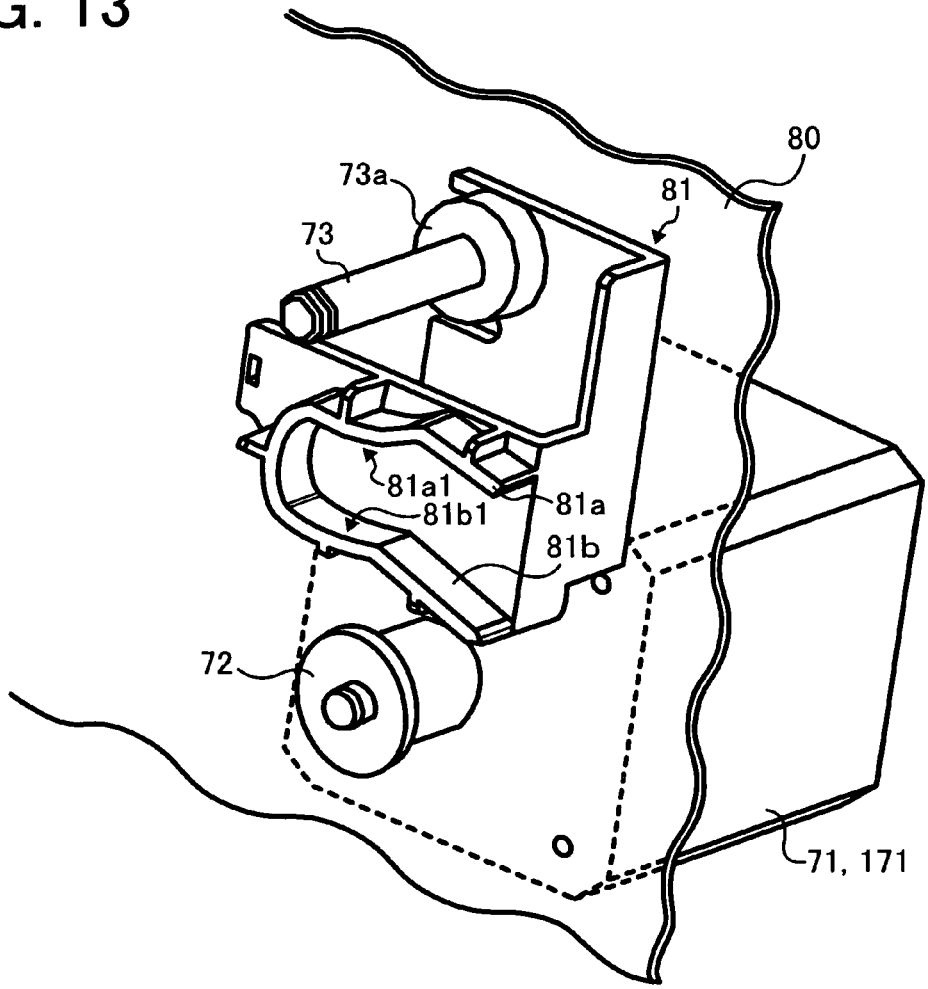
FIG. 13 is an enlarged perspective view of a part of the right side plate of the case of the color laser printer, and the regulating guide member fixed onto the right side plate by tightening a flange.

In the printer of the present embodiment, each of the attachment reference positions of the regulating guide member 81 and the right side plate 80 is set to the axis line of the first stud 73. Specifically, as illustrated in FIG. 12, the regulating guide member 81 includes an arc-shaped cut-away portion 81*c* acting as an engagement portion. In a process of attaching the regulating guide member 81 to the right side plate 80 of the case of the main body of the printer, the first stud 73 is engaged with the cut-away portion 81*c* first. Then, as illustrated in FIG. 13, the regulating guide member 81 is fixed onto the right side plate 80 by tightening a flange 73*a* screwed to the base side of the first stud 73. Thus, in the printer of the present embodiment, the cut-away portion 81*c* acting as an engagement portion is formed in the regulating guide member 81 acting as a curved surface forming member. Further, the positioning of the regulating guide member 81 to the right side plate 80 that supports the first stud 73 is set by engaging the first stud 73 with the cur-away portion 81*c*. In this configuration, because the attachment reference position in the right side plate 80 is set to the axis line of the first stud 73, an error of the relative position between the first stud 73 and the attachment reference position in the right side plate 80 is avoided. By this setting, as compared to a case in which the attachment reference position in the right side plate 80 is set to a position different from the first stud 73, the distance between the axial center of the first gear 74 and the axial center of the second gear 113 can be set with accuracy.

In the above-described printer, the second stud 119 is swingably supported around the relay stud 115. Alternatively, the second stud 119 may be moved along the rotation locus indicated by the alternate long and short dashed lines in FIG. 9 by the opening/closing operations of the open/close unit 100 without being swingably supported around the relay stud 115. The movement of the open/close unit 100 in its loosing direction may be also regulated in this alternative configuration. However, in this alternative configuration, the above-described problem caused by a positional error of attachment of the second gear 113 may not be solved. Specifically, the open/close unit 100 may not be securely closed due to the catch of the second gear 113 by the first gear 74 occurred before closing the open/close unit 100. Further, the second gear 113 may not properly engage the first gear 74, for example, the second gear 113 may be located at a position away from the first gear 74. Moreover, in this alternative configuration, because the second stud 119 is caught by the away-movement regulating guide portion 81*b* according to the opening/closing operations of the open/close unit 100, the away-movement regulating guide portion 81*b* cannot be provided (i.e., only the intruding movement regulating guide portion 81*a* can be provided) on the right side plate 80 of the case of the main body of the printer.

Figure 14:
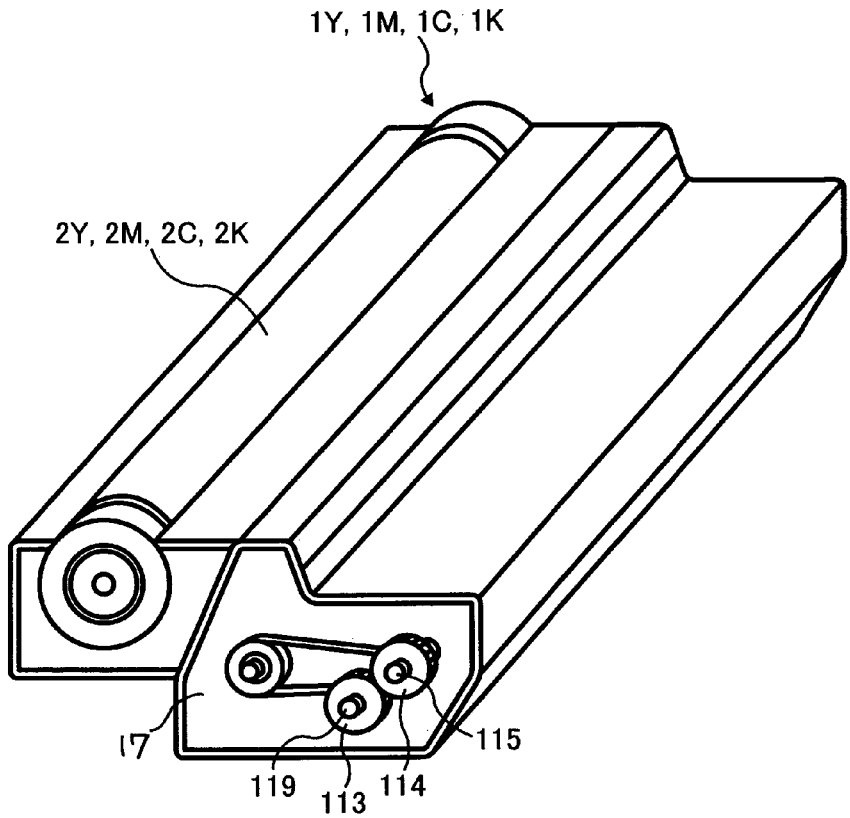
FIG. 14 is a perspective view of a process unit with a drive force transmitting system provided on a side case thereof according to another embodiment of the present invention.

The above-described drive force transmitting mechanism may be used for transmitting a drive force of a motor provided in the main body of the printer to any unit including a drive force transmitting system having a gear that receives the drive force of the motor, such as the process units 1Y, 1M, 1C, and 1K which are detachably attached to the main body of the printer. FIG. 14 is a perspective view of the process unit 1Y, 1M, 1C, and 1K with a drive force transmitting system including the second gear 113 and the relay rotary member 114. The configuration and function of the drive force transmitting system provided on a side case 17 of the process unit 1Y, 1M, 1C, and 1K are similar to those of the drive force transmitting system provided on the right side plate 112 of the open/close unit 100. As a non-limiting example, the process units 1Y, 1M, 1C, and 1K are detachably attached to the case (e.g., the right side plate 80) of the main body of the printer by opening an upper unit including the transfer unit 40 disposed above the process units 1Y, 1M, 1C, and 1K of the printer in FIG. 1. Specifically, when the upper unit of the printer is rotated around a rotation shaft (not shown) leftward in FIG. 1, the process units 1Y, 1M, 1C, and 1K are exposed to the outside. When installing the process units 1Y, 1M, 1C, and 1K into the main body of the printer, the process units 1Y, 1M, 1C, and 1K are inserted from the upper right-hand side of the printer in FIG. 1. Then, as described with reference to FIGS. 7 and 10, the end portion of the second stud 119 slidably contacts the convex curved surface 81*a*1 of the regulating guide member 81 by the inserting operations of the process units 1Y, 1M, 1C, and 1K. By engaging the second gear 113 with the first gear 74 supported by the right side plate 80 of the main body of the printer, a drive force of a motor 171 is transmitted to the second gear 113 via the first gear 74, thereby driving the photoreceptor, the drum-cleaning device, the discharging device, the charging device, and the developing device. Thus, in this example embodiment, a second holding unit configured to hold the second gear 113 is configured by the second stud 119 acting as a second shaft element, and the swing bracket 117 (illustration is omitted in FIG. 14)/the side case 17Y of the process unit 1Y acting as a second support element that supports the second stud 119.

As an alternative example, the drive force transmitting system may be provided to a side case of one of the process units 1Y, 1M, 1C, and 1K, and the drive force of the motor 171 received by the drive force transmitting system of the one of the process units 1Y, 1M, 1C, and 1K may be transmitted to the other process units by using a drive force transferring mechanism including a gear train, for example.

Figure 15:
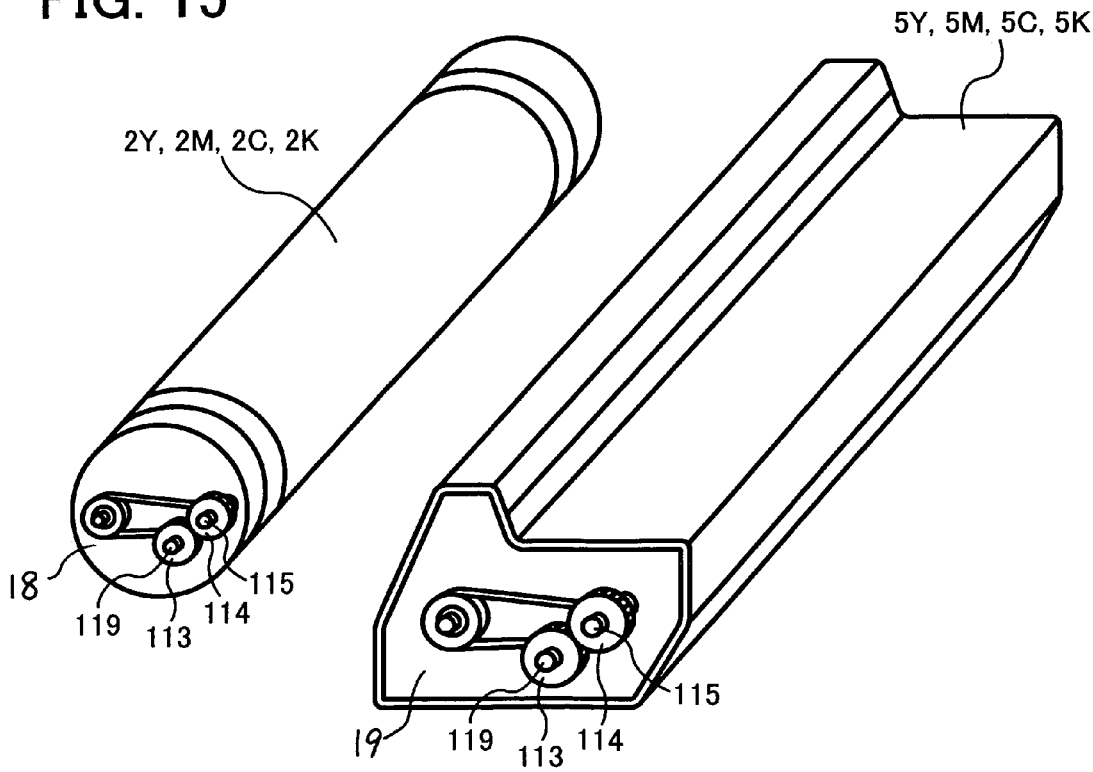
FIG. 15 is a perspective view of a photoreceptor and a developing device with drive force transmitting systems provided on each side case thereof according to another embodiment of the present invention.

Further, instead of accommodating the photoreceptor, the drum-cleaning device, the discharging device, the charging device, and the developing device in the process unit, the photoreceptor and the developing device may be independently attached to and detached from the main body of the printer. In this case, as illustrated in FIG. 15, the drive force transmitting system including the second gear 113 and the relay rotary member 114 may be provided on each side case 18 of the photoreceptor (2Y, 2M, 2C, and 2K) and each side case 19 of the developing device (5Y, 5M, 5C, and 5K). The photoreceptor and the developing device are detachably attached to the case (e.g., the right side plate 80) of the main body of the printer. By engaging the second gear 113 with the first gear 74 supported by the right side plate 80 of the main body of the printer, a drive force of the motor 171 is transmitted to the second gear 113 via the first gear 74, thereby driving the photoreceptor and the developing device. Thus, in this another example embodiment, a second holding unit configured to hold the second gear 113 is configured by the second stud 119 acting as a second shaft element, and the swing bracket 117 (illustration is omitted in FIG. 15)/each side case 18 of the photoreceptor (2Y, 2M, 2C, and 2K) and each side case 19 of the developing device (5Y, 5M, 5C, and 5K) acting as a second support element that supports the second stud 119.

The present invention has been described with respect to the exemplary embodiments illustrated in the figures. However, the present invention is not limited to these embodiments and may be practiced otherwise.

Figure 16:
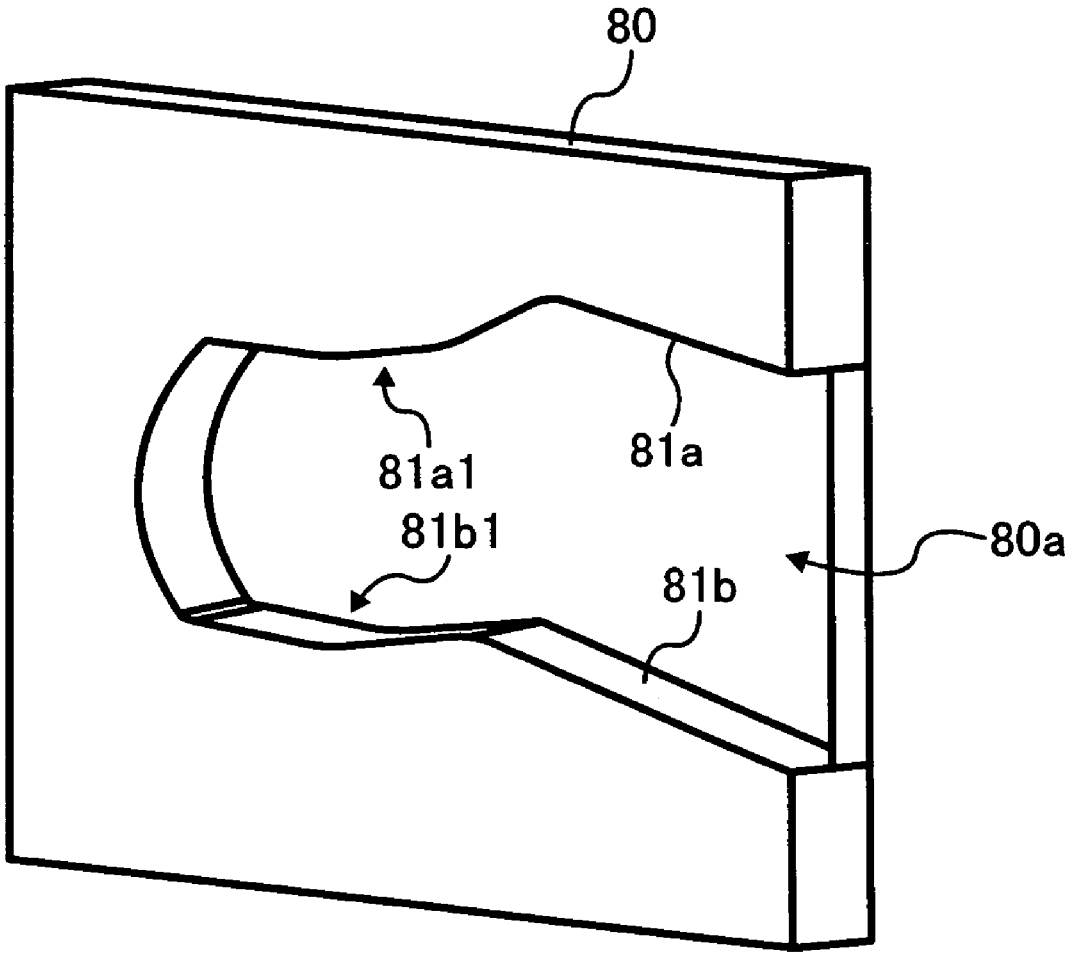
FIG. 16 is a perspective view of a part of the right side plate of the case of the color laser printer including a cut-away portion according to another embodiment of the present invention.

In the above-described embodiment, the regulating guide member 81 including the convex curved surface 81*a*1 and the concave curved surface 81*b*1 is fixed on the right side plate 80 as a separate member. Alternatively, as illustrated in FIG. 16, the convex curved surface 81*a*1 and the concave curved surface 81*b*1 are formed by inner walls of an opening portion or a cut-away portion 80*a* formed in the right side plate 80.

The present invention has been described with respect to a printer as an example of an image forming apparatus that forms images by an electrophotographic method. However, the present invention may be applied to an image forming apparatus that forms images by other methods, such as an imaging method using toner jet, an inkjet method, a thermal method, etc.

The present invention has been described with respect to a printer as an example of an image forming apparatus. However, the present invention may be applied to other image forming apparatuses, such as a copying machine, a facsimile machine, a multi-functional image forming apparatus, etc.

Further, in place of the full-color printer, a mono-color printer may also be used.

Moreover, in place of a tandem-type image forming apparatus including a plurality of photoreceptors, the present invention may be applied to an image forming apparatus including one photoreceptor on which toner images of different colors are sequentially formed.

Numerous additional modifications and variations of the present invention are possible in light of the above teachings. It is therefore understood that within the scope of the appended claims, the present invention may be practiced other than as specifically described herein.

The invention claimed is:

1. A drive force transmitting mechanism, comprising:

a first gear rotatably supported by a first shaft element;

a first holding unit configured to hold the first gear, the first holding unit including:

the first shaft element; and a first support element configured to support the first shaft element, the first support element including a curved surface that curves at a predetermined curvature relative to an axis line of the first shaft element;

a second gear rotatably supported by a second shaft element;

a second holding unit configured to hold the second gear, the second holding unit including:

the second shaft element; and a second support element configured to support the second shaft element, wherein the second holding unit is configured to move relative to the first holding unit, to thereby contact and separate the second gear with and from the first gear, a drive force is transmitted from the first gear to the second gear that is engaged with the first gear when the second holding unit moves to a predetermined position, and a movement of the second gear held by the second holding unit is regulated by abutting the second shaft element against the curved surface.

2. The drive force transmitting mechanism according to claim 1, wherein the first support element includes a side plate extending in a direction substantially perpendicular to the axis line of the first shaft element, the curved surface includes a concave curved surface that is formed by a curved surface forming member fixed on a lateral side of the side plate, at a position away from a position where the side plate supports the first shaft element, and the concave curved surface is configured to regulate the movement of the second gear in a direction for increasing a distance between an axial center of the first gear and an axial center of the second gear by abutting the second shaft element against the concave curved surface.

3. The drive force transmitting mechanism according to claim 1, wherein the first support element includes a side plate extending in a direction substantially perpendicular to the axis line of the first shaft element, the curved surface includes a concave curved surface that is formed by an inner wall of a cut-away portion formed in the side plate, at a position away from a position where the side plate supports the first shaft element, and the concave curved surface is configured to regulate the movement of the second gear in a direction for increasing a distance between an axial center of the first gear and an axial center of the second gear by abutting the second shaft element against the concave curved surface.

4. The drive force transmitting mechanism according to claim 2, wherein a circumferential surface of an end portion of the second shaft element abuts the concave curved surface, the second shaft element is provided on the second support element such that the second shaft element cannot rotate, and the second gear rotates on the circumferential surface of the second shaft element.

5. The drive force transmitting mechanism according to claim 3, wherein a circumferential surface of an end portion of the second shaft element abuts the concave curved surface, the second shaft element is provided on the second support element such that the second shaft element cannot rotate, and the second gear rotates on the circumferential surface of the second shaft element.

6. The drive force transmitting mechanism according to claim 4, wherein a radius of curvature of the concave curved surface is set to a value greater than a value obtained by adding a radius of the second shaft element to a distance between the axial center of the first gear and the axial center of the second gear when the second gear engages the first gear.

7. The drive force transmitting mechanism according to claim 5, wherein a radius of curvature of the concave curved surface is set to a value greater than a value obtained by adding a radius of the second shaft element to a distance between the axial center of the first gear and the axial center of the second gear when the second gear engages the first gear.

8. The drive force transmitting mechanism according to claim 1, wherein the first support element includes a side plate extending in a direction substantially perpendicular to the axis line of the first shaft element, the curved surface includes a convex curved surface that is formed by a curved surface forming member fixed on a lateral side of the side plate, at a position away from a position where the side plate supports the first shaft element, and the convex curved surface is configured to regulate the movement of the second gear in a direction for decreasing a distance between an axial center of the first gear and an axial center of the second gear by abutting the second shaft element against the convex curved surface.

9. The drive force transmitting mechanism according to claim 1, wherein the first support element includes a side plate extending in a direction substantially perpendicular to the axis line of the first shaft element, the curved surface includes a convex curved surface that is formed by an inner wall of a cut-away portion formed in the side plate, at a position away from a position where the side plate supports the first shaft element, and the convex curved surface is configured to regulate the movement of the second gear in a direction for decreasing a distance between an axial center of the first gear and an axial center of the second gear by abutting the second shaft element against the convex curved surface.

10. The drive force transmitting mechanism according to claim 8, wherein a circumferential surface of an end portion of the second shaft element abuts the convex curved surface, the second shaft element is provided on the second support element such that the second shaft element cannot rotate, and the second gear rotates on the circumferential surface of the second shaft element.

11. The drive force transmitting mechanism according to claim 9, wherein a circumferential surface of an end portion of the second shaft element abuts the convex curved surface, the second shaft element is provided on the second support element such that the second shaft element cannot rotate, and the second gear rotates on the circumferential surface of the second shaft element.

12. The drive force transmitting mechanism according to claim 10, wherein a radius of curvature of the convex curved surface is set to a value greater than a value obtained by subtracting a radius of the second shaft element from a distance between the axial center of the first gear and the axial center of the second gear when the second gear engages the first gear.

13. The drive force transmitting mechanism according to claim 11, wherein a radius of curvature of the convex curved surface is set to a value greater than a value obtained by subtracting a radius of the second shaft element from a distance between the axial center of the first gear and the axial center of the second gear when the second gear engages the first gear.

14. The drive force transmitting mechanism according to claim 1, wherein the second holding unit is configured to be detachably attached to the first support element, and is configured to be supported by the first support element such that the second holding unit moves in a direction in which the second holding unit is attached to and detached from the first support element.

15. The drive force transmitting mechanism according to claim 1, wherein the second holding unit is configured to rotate around a unit rotation shaft supported by the first holding unit.

16. The drive force transmitting mechanism according to claim 2, wherein the curved surface further includes a convex curved surface that is formed by the curved surface forming member at a position away from the position where the side plate supports the first shaft element, and the convex curved surface is configured to regulate the movement of the second gear in a direction for decreasing the distance between the axial center of the first gear and the axial center of the second gear by abutting the second shaft element against the convex curved surface.

17. The drive force transmitting mechanism according to claim 3, wherein the curved surface further includes a convex curved surface that is formed by the inner wall at a position away from the position where the side plate supports the first shaft element, and the convex curved surface is configured to regulate the movement of the second gear in a direction for decreasing the distance between the axial center of the first gear and the axial center of the second gear by abutting the second shaft element against the convex curved surface.

18. The drive force transmitting mechanism according to claim 1, wherein the second support element is configured to support the second shaft element such that the second shaft element swings around a swing shaft.

19. The drive force transmitting mechanism according to claim 2, wherein the curved surface forming member is formed from a material different from a material of the side plate, and the curved surface forming member includes an engagement portion and is positioned relative to the side plate by engaging the first shaft element with the engagement portion.

20. The drive force transmitting mechanism according to claim 8, wherein the curved surface forming member is formed from a material different from a material of the side plate, and the curved surface forming member includes an engagement portion and is positioned relative to the side plate by engaging the first shaft element with the engagement portion.

21. An image forming apparatus, comprising:

a visual image recording device configured to record a visual image on a recording material;

a conveyor device configured to convey the recording material to the visual image recording device;

a drive source configured to produce a drive force; and a drive force transmitting mechanism configured to transmit the drive force from the drive source to the conveyor device, the drive force transmitting mechanism including:

a first gear rotatably supported by a first shaft element;

a first holding unit configured to hold the first gear, the first holding unit including:

the first shaft element; and a first support element configured to support the first shaft element, the first support element including a curved surface that curves at a predetermined curvature relative to an axis line of the first shaft element;

a second gear rotatably supported by a second shaft element;

a second holding unit configured to hold the second gear, the second holding unit including:

the second shaft element; and a second support element configured to support the second shaft element, wherein the second holding unit is configured to move relative to the first holding unit, to thereby contact and separate the second gear with and from the first gear, the drive force of the drive source is transmitted from the first gear to the second gear that is engaged with the first gear when the second holding unit moves to a predetermined position, and a movement of the second gear held by the second holding unit is regulated by abutting the second shaft element against the curved surface.

22. An image forming apparatus, comprising:

a latent image carrier configured to carry a latent image on the latent image carrier;

a developing device configured to develop the latent image to form a visual image, at least one of the latent image carrier and the developing device being detachably attached to a side plate of the image forming apparatus;

a transfer device configured to transfer the visual image to a recording material one of directly from the latent image carrier and indirectly through an intermediate transfer element;

a drive source configured to produce a drive force; and a drive force transmitting mechanism configured to transmit the drive force from the drive source to the at least one of the latent image carrier and the developing device, the drive force transmitting mechanism including:

a first gear rotatably supported by a first shaft element;

a first holding unit configured to hold the first gear, the first holding unit including:

the first shaft element; and a first support element configured to support the first shaft element, the first support element including the side plate of the image forming apparatus which extends in a direction substantially perpendicular to an axis line of the first shaft element, the side plate including a curved surface that curves at a predetermined curvature relative to the axis line of the first shaft element;

a second gear rotatably supported by a second shaft element;

a second holding unit configured to hold the second gear, the second holding unit including:

the second shaft element; and a second support element configured to support the second shaft element, the second support element including a side case of the at least one of the latent image carrier and the developing device, wherein the second holding unit is configured to move relative to the first holding unit, to thereby contact and separate the second gear with and from the first gear, the drive force of the drive source is transmitted from the first gear to the second gear that is engaged with the first gear when the second holding unit moves to a predetermined position, and a movement of the second gear held by the second holding unit is regulated by abutting the second shaft element against the curved surface, and wherein the second holding unit is configured to be detachably attached to the side plate of the image forming apparatus, and is configured to be supported by the side plate such that the second holding unit moves in a direction in which the second holding unit is attached to and detached from the side plate.

23. An image forming apparatus, comprising:

a latent image carrier configured to carry a latent image on the latent image carrier;

a developing device configured to develop the latent image to form a visual image;

a transfer device configured to transfer the visual image to a recording material one of directly from the latent image carrier and indirectly through an intermediate transfer element;

a cleaning device configured to clean a surface of the latent image carrier;

a process unit configured to accommodate the latent image carrier and at least one of the developing device and the cleaning device, the process unit being detachably attached to a side plate of the image forming apparatus;

a drive source configured to produce a drive force; and a drive force transmitting mechanism configured to transmit the drive force from the drive source to the process unit, the drive force transmitting mechanism including:

a first gear rotatably supported by a first shaft element;

a first holding unit configured to hold the first gear, the first holding unit including:

the first shaft element; and a first support element configured to support the first shaft element, the first support element including the side plate of the image forming apparatus which extends in a direction substantially perpendicular to an axis line of the first shaft element, the side plate including a curved surface that curves at a predetermined curvature relative to the axis line of the first shaft element;

a second gear rotatably supported by a second shaft element;

a second holding unit configured to hold the second gear, the second holding unit including:

the second shaft element; and a second support element configured to support the second shaft element, the second support element including a side case of the process unit, wherein the second holding unit is configured to move relative to the first holding unit, to thereby contact and separate the second gear with and from the first gear, the drive force of the drive source is transmitted from the first gear to the second gear that is engaged with the first gear when the second holding unit moves to a predetermined position, and a movement of the second gear held by the second holding unit is regulated by abutting the second shaft element against the curved surface, and wherein the second holding unit is configured to be detachably attached to the side plate of the image forming apparatus, and is configured to be supported by the side plate such that the second holding unit moves in a direction in which the second holding unit is attached to and detached from the side plate.

24. A drive force transmitting mechanism, comprising:

a first gear rotatably supported by a first shaft element;

first means for holding the first gear, the first means for holding including:

the first shaft element; and first means for supporting the first shaft element, the first means for supporting including a curved surface that curves at a predetermined curvature relative to an axis line of the first shaft element;

a second gear rotatably supported by a second shaft element;

second means for holding the second gear, the second means for holding including:

the second shaft element; and second means for supporting the second shaft element, wherein the second means for holding moves relative to the first means for holding, to thereby contact and separate the second gear with and from the first gear, a drive force is transmitted from the first gear to the second gear that is engaged with the first gear when the second means for holding moves to a predetermined position, and a movement of the second gear held by the second means for holding is regulated by abutting the second shaft element against the curved surface.

* * * * *